US012209496B2

(12) United States Patent
Clausen et al.

(10) Patent No.: US 12,209,496 B2
(45) Date of Patent: Jan. 28, 2025

(54) DOWNHOLE ADJUSTABLE BEND ASSEMBLIES

(71) Applicant: National Oilwell Varco, L.P., Houston, TX (US)

(72) Inventors: Jeffery Ronald Clausen, Tulsa, OK (US); Nicholas Ryan Marchand, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 17/773,113

(22) PCT Filed: Oct. 30, 2020

(86) PCT No.: PCT/US2020/058339
§ 371 (c)(1),
(2) Date: Apr. 29, 2022

(87) PCT Pub. No.: WO2021/087347
PCT Pub. Date: May 6, 2021

(65) Prior Publication Data

US 2024/0151109 A1 May 9, 2024

Related U.S. Application Data

(60) Provisional application No. 62/928,216, filed on Oct. 30, 2019.

(51) Int. Cl.
*E21B 7/06* (2006.01)
*E21B 21/08* (2006.01)
*E21B 47/024* (2006.01)

(52) U.S. Cl.
CPC ..... *E21B 7/067* (2013.01); *E21B 21/08* (2013.01); *E21B 47/024* (2013.01)

(58) Field of Classification Search
CPC ..... E21B 7/067; E21B 21/08; E21B 47/024
See application file for complete search history.

(56) References Cited

U.S. PATENT DOCUMENTS 2,255,695 A 9/1941 Bull
5,117,927 A 6/1992 Askew
(Continued)

FOREIGN PATENT DOCUMENTS

WO 2014-042644 A1 3/2014

OTHER PUBLICATIONS

Saudi Examination Report dated May 18, 2023 for U.S. Appl. No. 52/243,251 and English translation.
(Continued)

*Primary Examiner* — Dany E Akakpo
(74) *Attorney, Agent, or Firm* — Conley Rose, P.C.

(57) ABSTRACT

A downhole mud motor includes a driveshaft housing, a driveshaft rotatably disposed in the driveshaft housing, a bearing mandrel coupled to the driveshaft, and a bend adjustment assembly including a first position, wherein the bend adjustment assembly includes a second position, wherein the bend adjustment assembly includes an adjustment mandrel having a first axial position corresponding to the first position of the bend adjustment assembly and a second axial position which corresponds to the second position of the bend adjustment assembly, and wherein the bend adjustment assembly is prevented from actuating from the first position to the second position when the adjustment mandrel is in the first axial position, and wherein the bend adjustment assembly is permitted to actuate between the first position and the second position when the adjustment mandrel is in a second axial position that is axially spaced from the first axial position.

26 Claims, 19 Drawing Sheets

(56) References Cited

U.S. PATENT DOCUMENTS

| | | | | |
|---|---|---|---|---|
| 9,605,481 | B1 | 3/2017 | Bleeker | |
| 2005/0056463 | A1 | 3/2005 | Aronstam et al. | |
| 2014/0251695 | A1* | 9/2014 | Marchand | E21B 7/067 175/74 |
| 2016/0348441 | A1* | 12/2016 | Zhou | E21B 10/26 |
| 2019/0234149 | A1 | 8/2019 | Clausen et al. | |

OTHER PUBLICATIONS

International Search Report and Written Opinion dated Feb. 22, 2021, for Application No. PCT/US2020/058339 (12 pgs).

* cited by examiner

DOWNHOLE ADJUSTABLE BEND ASSEMBLIES

CROSS-REFERENCE TO RELATED APPLICATIONS

This application is a 35 U.S.C. § 371 national stage application of PCT/US2020/058339 filed Oct. 30, 2020, and entitled "Downhole Adjustable Bend Assemblies", which claims benefit of U.S. provisional application Ser. No. 62/928,216 filed Oct. 30, 2019, and entitled "Downhole Adjustable Bend Assemblies," both of which are hereby incorporated herein by reference in their entirety.

STATEMENT REGARDING FEDERALLY SPONSORED RESEARCH OR DEVELOPMENT

Not applicable.

BACKGROUND

In drilling a borehole into an earthen formation, such as for the recovery of hydrocarbons or minerals from a subsurface formation, it is typical practice to connect a drill bit onto the lower end of a drillstring formed from a plurality of pipe joints connected together end-to-end, and then rotate the drillstring so that the drill bit progresses downward into the earth to create a borehole along a predetermined trajectory. In vertical drilling operations, the drillstring and drill bit are typically rotated from the surface with a top dive or rotary table. Drilling fluid or "mud" is typically pumped under pressure down the drillstring, out the face of the drill bit into the borehole, and then up the annulus between the drillstring and the borehole sidewall to the surface. The drilling fluid, which may be water-based or oil-based, is typically viscous to enhance its ability to carry borehole cuttings to the surface.

In some applications, horizontal and other non-vertical or deviated boreholes are drilled (i.e., "directional drilling") to facilitate greater exposure to and production from larger regions of subsurface hydrocarbon-bearing formations than would be possible using only vertical boreholes. In directional drilling, specialized drillstring components and "bottomhole assemblies" (BHAs) may be used to induce, monitor, and control deviations in the path of the drill bit, so as to produce a borehole of the desired deviated configuration. Directional drilling may be carried out using a downhole or mud motor provided in the BHA at the lower end of the drillstring immediately above the drill bit. Downhole mud motors may include several components, such as, for example (in order, starting from the top of the motor): (1) a power section including a stator and a rotor rotatably disposed in the stator; (2) a driveshaft assembly including a driveshaft disposed within a housing, with the upper end of the driveshaft being coupled to the lower end of the rotor; and (3) a bearing assembly positioned between the driveshaft assembly and the drill bit for supporting radial and thrust loads. For directional drilling, the motor may include a bent housing to provide an angle of deflection between the drill bit and the BHA.

BRIEF SUMMARY OF THE DISCLOSURE

An embodiment of a downhole mud motor comprises a driveshaft housing, a driveshaft rotatably disposed in the driveshaft housing, a bearing mandrel coupled to the driveshaft, and a bend adjustment assembly comprising a first position that provides a first deflection angle between a longitudinal axis of the driveshaft housing and a longitudinal axis of the bearing mandrel, wherein the bend adjustment assembly includes a second position that provides a second deflection angle between the longitudinal axis of the driveshaft housing and the longitudinal axis of the bearing mandrel that is different from the first deflection angle, wherein the bend adjustment assembly comprises an adjustment mandrel having a first axial position corresponding to the first position of the bend adjustment assembly and a second axial position axially spaced from the first position and which corresponds to the second position of the bend adjustment assembly, wherein the bend adjustment assembly is prevented from actuating from the first position to the second position when the adjustment mandrel is in the first axial position, and wherein the bend adjustment assembly is permitted to actuate between the first position and the second position when the adjustment mandrel is in a second axial position that is axially spaced from the first axial position. In some embodiments, interlocking engagement between the adjustment mandrel and an offset housing prevent the bend adjustment assembly from actuating from the first position to the second position when the adjustment mandrel is in the first axial position, and the adjustment mandrel is configured to shift from the first axial position to the second axial position in response to supplying the downhole mud motor with drilling fluid at a threshold pressure or a threshold flowrate. In some embodiments, the offset housing comprises a first plurality of circumferentially spaced protrusions and the adjustment mandrel comprises a second plurality of circumferentially spaced protrusions, and the first plurality of protrusions are interlocked with the second plurality of protrusions when the bend adjustment assembly is in the first position, and wherein the first plurality of protrusions are disengaged from the second plurality of protrusions when the bend adjustment assembly is in the second position. In certain embodiments, the bend adjustment assembly includes a third position that provides a third deflection angle between the longitudinal axis of the driveshaft housing and the longitudinal axis of the bearing mandrel that is different from the first deflection angle and the second deflection angle, and wherein the second axial position of the adjustment mandrel corresponds to the third position of the bend adjustment assembly. In certain embodiments, the downhole mud motor further comprises an actuator assembly configured to shift the bend adjustment assembly between the second position and the third position in response to a change in at least one of flowrate of a drilling fluid supplied to the downhole mud motor, pressure of the drilling fluid supplied to the downhole mud motor, and relative rotation between the driveshaft housing and the bearing mandrel. In some embodiments, the downhole mud motor further comprises a shear pin configured to retain the adjustment mandrel in the first axial position, wherein the shear pin is configured to shear and release the adjustment mandrel from the first axial position in response to supplying the downhole mud motor with drilling fluid at a threshold pressure or a threshold flowrate, and a locking pin configured to retain the adjustment mandrel in the second axial position. In some embodiments, the downhole mud motor further comprises a locking piston configured to lock the bend adjustment assembly in the second position. In certain embodiments, the adjustment mandrel comprises an arcuate recess extending between a pair of shoulders, the offset housing comprises an arcuate extension extending between a pair of shoulders, and one of the pair of shoulders of the offset housing engages one of the shoulders of the adjustment mandrel when the bend adjustment assembly is in the first position. In certain embodiments, the bend adjustment assembly is actuatable between the first position and the second position with the adjustment mandrel in the second axial position in response to a change in at least one of flowrate of the drilling fluid supplied to the downhole mud motor, pressure of the drilling fluid supplied to the downhole mud motor, and relative rotation between the driveshaft housing and the bearing mandrel. In certain embodiments, the adjustment mandrel comprises an arcuate recess extending between a pair of shoulders, the offset housing comprises an arcuate extension extending between a pair of shoulders, and each of the pair of shoulders of the offset housing is spaced from each of the shoulders of the adjustment mandrel when the bend adjustment assembly is in the first position. In some embodiments, the downhole mud motor further comprises a stepped flow restrictor positioned on an outer surface of the driveshaft, wherein the flow restrictor comprises a pair of axially spaced choke points configured to restrict a flow of the drilling fluid between the driveshaft and a locking piston disposed about the driveshaft and to provide a surface indication of the deflection angle of the bend adjustment assembly.

An embodiment of a downhole mud motor comprises a driveshaft housing, a driveshaft rotatably disposed in the driveshaft housing, a bearing mandrel coupled to the driveshaft, and a bend adjustment assembly comprising a first position that provides a first deflection angle between a longitudinal axis of the driveshaft housing and a longitudinal axis of the bearing mandrel, wherein the bend adjustment assembly includes a second position that provides a second deflection angle between the longitudinal axis of the driveshaft housing and the longitudinal axis of the bearing mandrel that is different from the first deflection angle, wherein the bend adjustment assembly comprises an adjustment mandrel having a first axial position corresponding only to the first position of the bend adjustment assembly and a second axial position axially spaced from the first position and which corresponds only to the second position of the bend adjustment assembly. In some embodiments, the adjustment mandrel is configured to shift from the first axial position to the second axial position in response to supplying the downhole mud motor with drilling fluid at a threshold pressure or a threshold flowrate. In some embodiments, the downhole mud motor further comprises a locking piston configured to lock the bend adjustment assembly in the second position. In certain embodiments, the locking piston comprises a key displaceable directly and arcuately between a short slot and a long slot of the adjustment mandrel in response to actuation of the adjustment mandrel from the first axial position to the second axial position. In certain embodiments, the adjustment mandrel comprises an arcuate recess extending between a pair of shoulders, the offset housing comprises an arcuate extension extending between a pair of shoulders, and one of the pair of shoulders of the offset housing engages one of the shoulders of the adjustment mandrel when the bend adjustment assembly is in the first position. In some embodiments, the bend adjustment assembly is actuatable between the first position and the second position with the adjustment mandrel in the second axial position in response to a change in at least one of flowrate of the drilling fluid supplied to the downhole mud motor, pressure of the drilling fluid supplied to the downhole mud motor, and relative rotation between the driveshaft housing and the bearing mandrel. In some embodiments, the downhole mud motor further comprises a stepped flow restrictor positioned on an outer surface of the driveshaft, wherein the flow restrictor comprises a pair of axially spaced choke points configured to restrict a flow of the drilling fluid between the driveshaft and a locking piston disposed about the driveshaft and to provide a surface indication of the deflection angle of the bend adjustment assembly. In some embodiments, the downhole mud motor further comprises a shear pin configured to retain the adjustment mandrel in the first axial position, wherein the shear pin is configured to shear and release the adjustment mandrel from the first axial position in response to supplying the downhole mud motor with drilling fluid at a threshold pressure or a threshold flowrate, and a locking pin configured to retain the adjustment mandrel in the second axial position.

An embodiment of a method for forming a deviated borehole comprises (a) providing a bend adjustment assembly of a downhole mud motor in a first position that provides a first deflection angle between a longitudinal axis of a driveshaft housing of the downhole mud motor and a longitudinal axis of a bearing mandrel of the downhole mud motor, (b) actuating an adjustment mandrel of the bend adjustment assembly from a first axial position corresponding to the first position of the bend adjustment assembly to a second axial position axially spaced from the first position in response supplying the downhole mud motor with drilling fluid at a threshold pressure or a threshold flowrate, and (c) with the downhole mud motor positioned in the borehole, actuating the bend adjustment assembly from the first position to a second position that provides a second deflection angle between the longitudinal axis of the driveshaft housing and the longitudinal axis of the bearing mandrel, the second deflection angle being different from the first deflection angle, wherein the bend adjustment assembly is prevented from actuating from the first position to the second position when the adjustment mandrel is in the first axial position, and wherein the bend adjustment assembly is permitted to actuate between the first position and the second position when the adjustment mandrel is in a second axial position that is axially spaced from the first axial position. In some embodiments, the method further comprises (d) ceasing the supply of drilling fluid to the bend adjustment assembly while retaining the bend adjustment assembly in the second position. In some embodiments, (b) comprises shearing a shear pin coupled to the adjustment mandrel in response to supplying the downhole mud motor with the drilling fluid at the threshold pressure or the threshold flowrate. In certain embodiments, the method further comprises (d) with the downhole mud motor positioned in the borehole and the adjustment mandrel disposed in the second axial position, actuating the bend adjustment assembly from the second position to a third position that provides a third deflection angle between the longitudinal axis of the driveshaft housing and the longitudinal axis of the bearing mandrel, the third deflection angle being different from the second deflection angle. In certain embodiments, the third deflection angle equals the first deflection angle. In some embodiments, (d) comprises (d1) reducing a flowrate of the drilling fluid supplied to the downhole mud motor, (d2) applying a weight on bit (WOB) to the downhole mud motor while rotating a drillstring coupled to the downhole mud motor from the surface, and (d3) increasing the flowrate of drilling fluid supplied to the downhole mud motor to lock the bend adjustment assembly in the third position. In some embodiments, (d) comprises transferring torque between the bearing mandrel to an actuator housing by an actuator assembly of the bend adjustment assembly.

BRIEF DESCRIPTION OF THE DRAWINGS

For a detailed description of disclosed embodiments, reference will now be made to the accompanying drawings in which.

DETAILED DESCRIPTION OF DISCLOSED EMBODIMENTS

Figure 1:
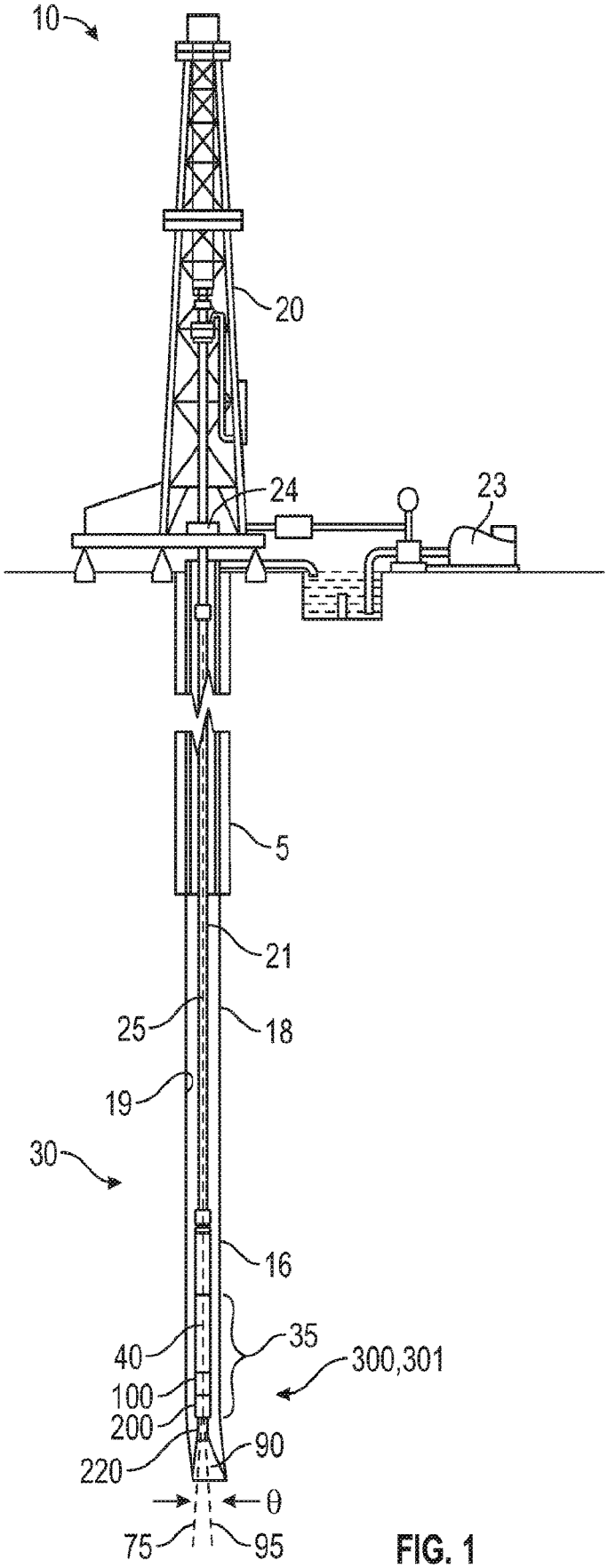
FIG. 1 is a schematic partial cross-sectional view of a drilling system including a downhole mud motor according to some embodiments.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring to FIG. 1, an embodiment of a well system 10 is shown. Well system 10 is generally configured for drilling a borehole 16 in an earthen formation 5. In the embodiment of FIG. 1, well system 10 includes a drilling rig 20 disposed at the surface, a drillstring 21 extending downhole from rig 20, a bottomhole assembly (BHA) 30 coupled to the lower end of drillstring 21, and a drill bit 90 attached to the lower end of BHA 30. A surface or mud pump 23 is positioned at the surface and is configured to pump drilling fluid or mud through drillstring 21. Additionally, rig 20 includes a rotary system 24 for imparting torque to an upper end of drillstring 21 to thereby rotate drillstring 21 in borehole 16. In this embodiment, rotary system 24 comprises a rotary table located at a rig floor of rig 20; however, in other embodiments, rotary system 24 may comprise other systems for imparting rotary motion to drillstring 21, such as a top drive. A downhole mud motor 35 is provided in BHA 30 for facilitating the drilling of deviated portions of borehole 16. Moving downward along BHA 30, motor 35 includes a hydraulic drive or power section 40, a driveshaft assembly 100, and a bearing assembly 200. In some embodiments, the portion of BHA 30 disposed between drillstring 21 and motor 35 can include other components, such as drill collars, measurement-while-drilling (MWD) tools, reamers, stabilizers and the like.

Power section 40 of BHA 30 converts the fluid pressure of the drilling fluid pumped downward through drillstring 21 into rotational torque for driving the rotation of drill bit 90. Driveshaft assembly 100 and bearing assembly 200 transfer the torque generated in power section 40 to bit 90. With force or weight applied to the drill bit 90 by the drillstring 21 and BHA 30, also referred to as weight-on-bit ("WOB"), the rotating drill bit 90 engages the earthen formation and proceeds to form borehole 16 along a predetermined path toward a target zone. The drilling fluid or mud pumped down the drillstring 21 and through BHA 30 from surface pump 23 passes out of the face of drill bit 90 and back up the annulus 18 formed between drillstring 21 and the wall 19 of borehole 16. The drilling fluid cools the bit 90, and flushes the cuttings away from the face of bit 90 and carries the cuttings to the surface.

Figure 2:
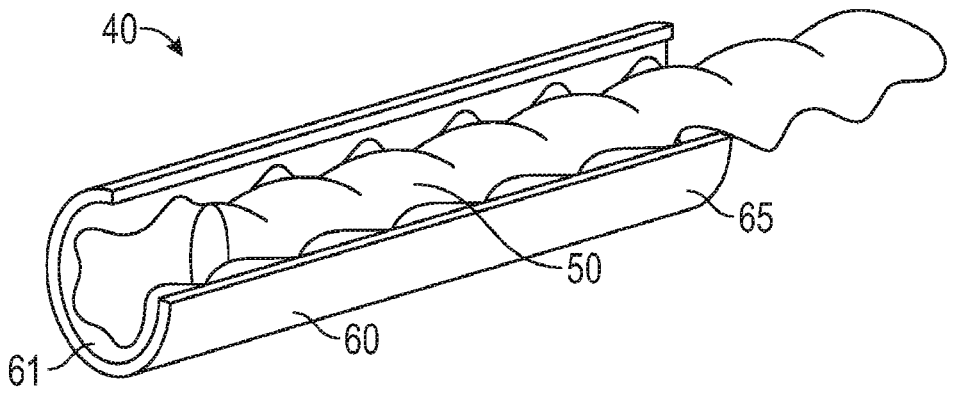
FIG. 2 is a perspective, partial cut-away view of the power section of FIG. 1.
Figure 3:
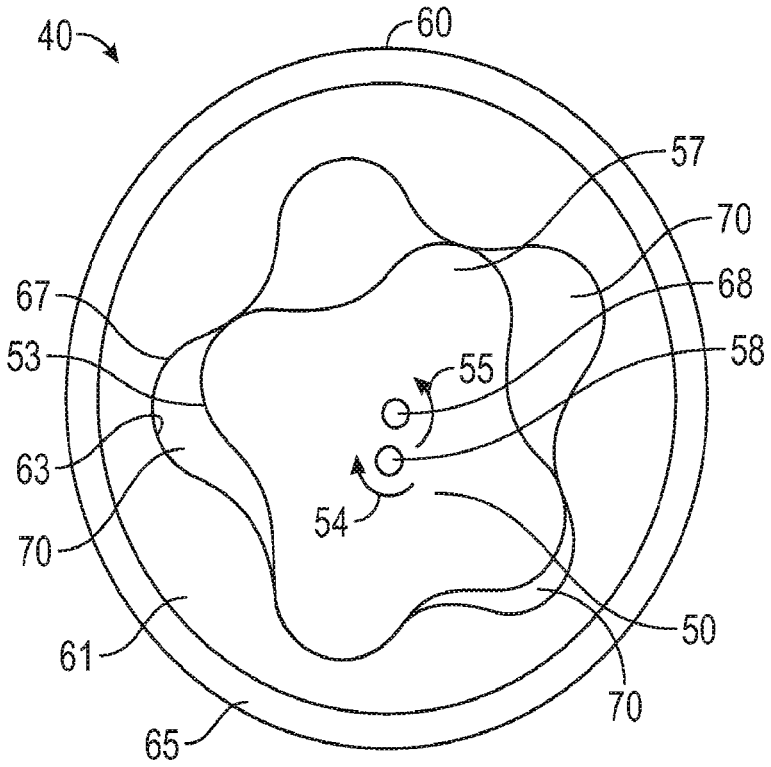
FIG. 3 is a cross-sectional end view of the power section of FIG. 1.

Referring to FIGS. 1-3, an embodiment of the power section 40 of BHA 30 is shown schematically in FIGS. 2 and 3. In the embodiment of FIGS. 2 and 3, power section 40 comprises a helical-shaped rotor 50 disposed within a stator 60 comprising a cylindrical stator housing 65 lined with a helical-shaped elastomeric insert 61. Helical-shaped rotor 50 defines a set of rotor lobes 57 that intermesh with a set of stator lobes 67 defined by the helical-shaped insert 61. As best shown in FIG. 3, the rotor 50 has one fewer lobe 57 than the stator 60. When the rotor 50 and the stator 60 are assembled, a series of cavities 70 are formed between the outer surface 53 of the rotor 50 and the inner surface 63 of the stator 60. Each cavity 70 is sealed from adjacent cavities 70 by seals formed along the contact lines between the rotor 50 and the stator 60. The central axis 58 of the rotor 50 is radially offset from the central axis 68 of the stator 60 by a fixed value known as the "eccentricity" of the rotor-stator assembly. Consequently, rotor 50 may be described as rotating eccentrically within stator 60.

During operation of the hydraulic drive section 40, fluid is pumped under pressure into one end of the hydraulic drive section 40 where it fills a first set of open cavities 70. A pressure differential across the adjacent cavities 70 forces the rotor 50 to rotate relative to the stator 60. As the rotor 50 rotates inside the stator 60, adjacent cavities 70 are opened and filled with fluid. As this rotation and filling process repeats in a continuous manner, the fluid flows progressively down the length of hydraulic drive section 40 and continues to drive the rotation of the rotor 50. Driveshaft assembly 100 shown in FIG. 1 includes a driveshaft discussed in more detail below that has an upper end coupled to the lower end of rotor 50. In this arrangement, the rotational motion and torque of rotor 50 is transferred to drill bit 90 via driveshaft assembly 100 and bearing assembly 200.

In the embodiment of FIGS. 1-3, driveshaft assembly 100 is coupled to bearing assembly 200 via a bend adjustment assembly 300 of BHA 30 that provides an adjustable bend 301 along motor 35. Bend 301 forms a deflection angle θ between a central or longitudinal axis 95 (shown in FIG. 1) of drill bit 90 and the longitudinal axis 25 of drillstring 21.

In an embodiment, drillstring 21 is rotated from rig 20 with a rotary table or top drive to rotate BHA 30 and drill bit 90 coupled thereto to drill a straight section of borehole 16. Drillstring 21 and BHA 30 rotate about the longitudinal axis of drillstring 21, and thus, drill bit 90 is also forced to rotate about the longitudinal axis of drillstring 21. With bit 90 disposed at deflection angle θ, the lower end of drill bit 90 distal BHA 30 seeks to move in an arc about longitudinal axis 25 of drillstring 21 as it rotates, but is restricted by the sidewall 19 of borehole 16, thereby imposing bending moments and associated stress on BHA 30 and mud motor 35. In general, the magnitudes of such bending moments and associated stresses are directly related to the bit-to-bend distance D—the greater the bit-to-bend distance D, the greater the bending moments and stresses experienced by BHA 30 and mud motor 35.

In general, driveshaft assembly 100 functions to transfer torque from the eccentrically-rotating rotor 50 of power section 40 to a concentrically-rotating bearing mandrel 220 (shown in FIG. 1) of bearing assembly 200 and drill bit 90. As best shown in FIG. 3, rotor 50 rotates about rotor axis 58 in the direction of arrow 54, and rotor axis 58 rotates about stator axis 68 in the direction of arrow 55. However, drill bit 90 and bearing mandrel 220 are coaxially aligned and rotate about a common axis that is offset and/or oriented at an acute angle relative to rotor axis 58. Thus, driveshaft assembly 100 converts the eccentric rotation of rotor 50 to the concentric rotation of bearing mandrel 220 and drill bit 90, which are radially offset and/or angularly skewed relative to rotor axis 58.

Figure 4:
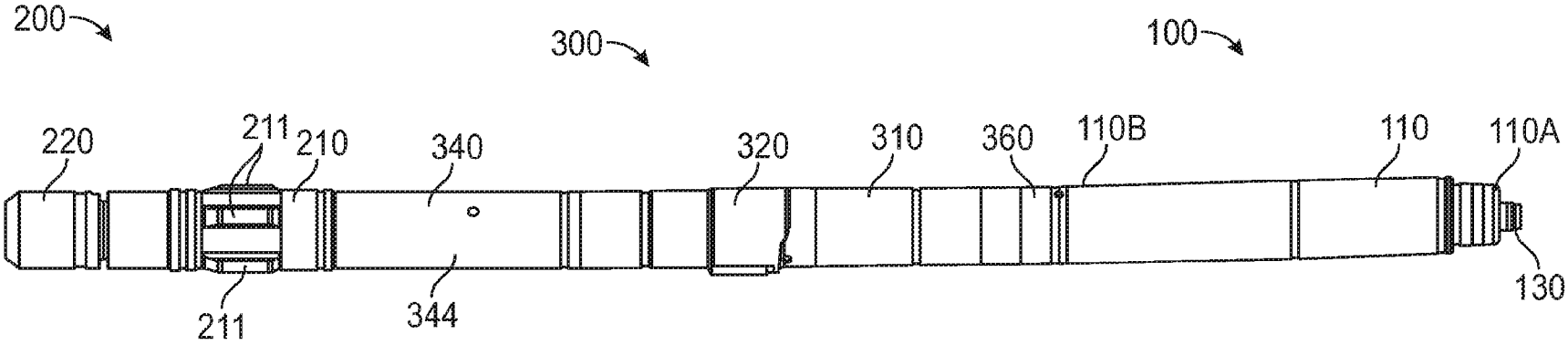
FIG. 4 is a side view of a mud motor of FIG. 1, FIG. 4 illustrating a driveshaft assembly, a bearing assembly, and a bend adjustment assembly of the mud motor of FIG. 1 disposed in a first position according to some embodiments.
Figure 5:
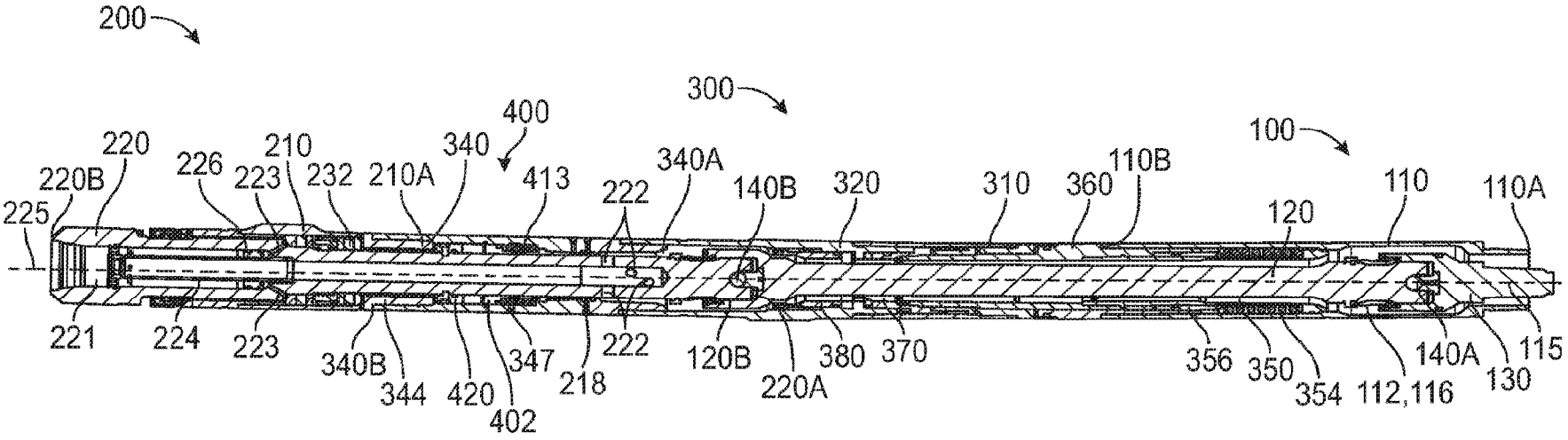
FIG. 5 is a side cross-sectional view of the mud motor of FIG. 4.
Figure 7:
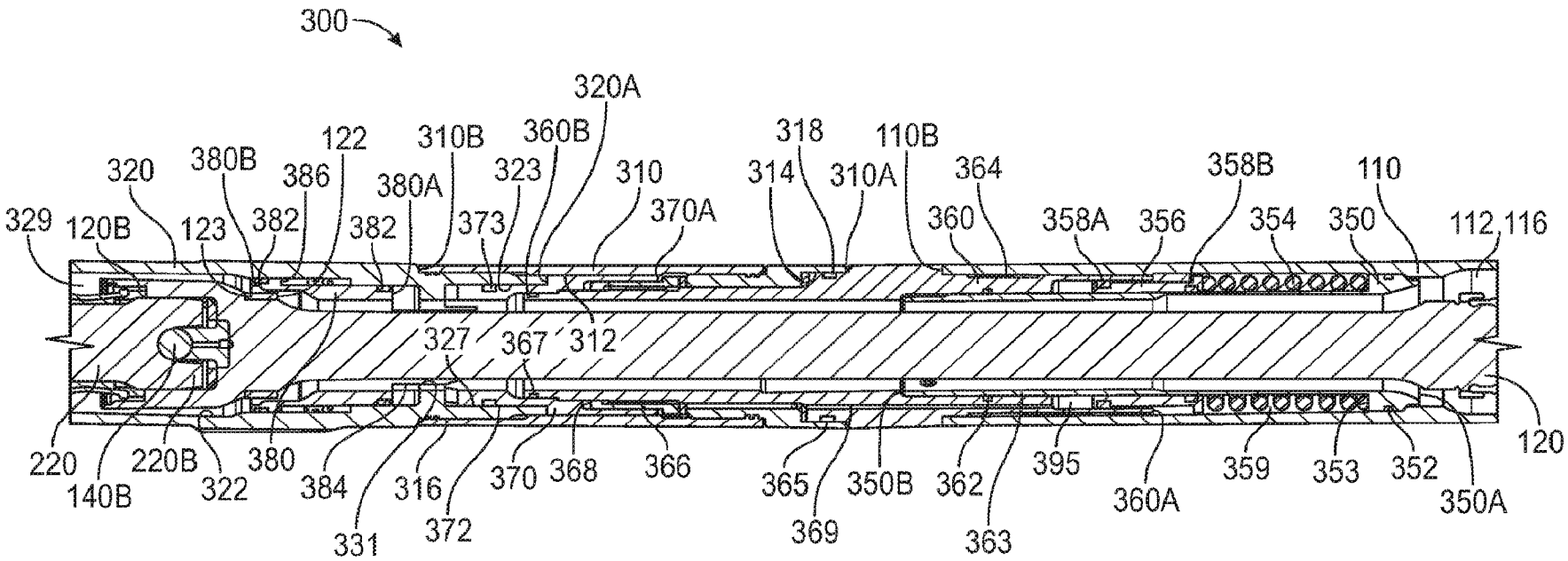
FIG. 7 is a zoomed-in, side cross-sectional view of the bend adjustment assembly of FIG. 4.

Referring to FIGS. 1, 4, 5, and 7, embodiments of driveshaft assembly 100, bearing assembly 200, and bend adjustment assembly 300 are shown. In the embodiment of FIGS. 4, 5, and 7, driveshaft assembly 100 includes an outer driveshaft housing 110 and a one-piece (i.e., unitary) driveshaft 120 rotatably disposed within housing 110. Housing 110 has a linear central or longitudinal axis 115, a first or upper end 110A, a second or lower end 110B opposite upper end 110A and coupled to an outer bearing housing 210 of bearing assembly 200 via the bend adjustment assembly 300. Driveshaft housing 110 also includes a central bore or passage 112 extending between ends 110A and 110B. In an embodiment, an externally threaded connector or pin end of driveshaft housing 110 is located at upper end 110A which threadably engages a mating internally threaded connector or box end comprising the lower end of stator housing 65. Additionally, an internally threaded connector or box end of driveshaft housing 110 may be located at lower end 110B and threadably engage a mating externally threaded connector of bend adjustment assembly 300.

Figure 13:
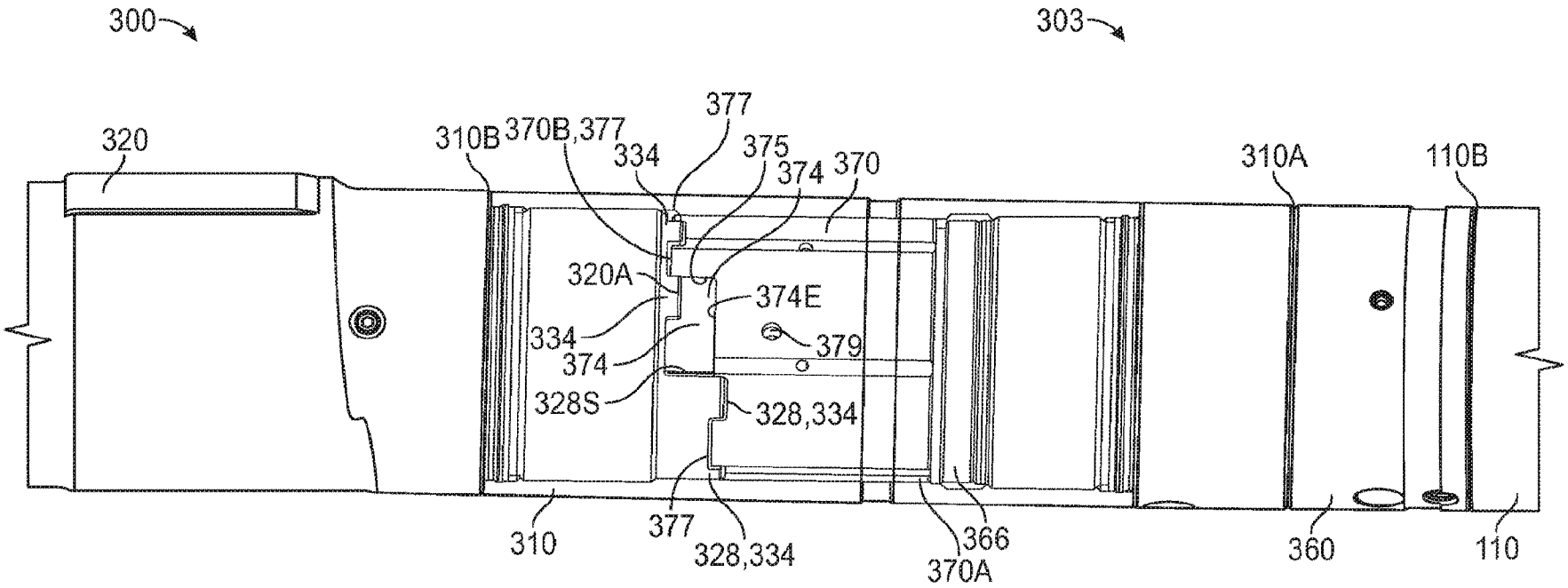
FIG. 13 is a zoomed-in side view of the bearing assembly of FIG. 4 in the first position.

As best shown in FIGS. 1, 3, driveshaft housing 110 may be coaxially aligned with stator housing 65. As will be discussed further herein, bend adjustment assembly 300 is configured to actuate between a first position 303 (shown in FIGS. 5, 7, and 13), a second position 305 (shown in FIGS. 14, 15), and a third position 307 (shown in FIGS. 16, 17). When bend adjustment assembly 300 is in the first position 303, central axis 115 of driveshaft housing 110 may be disposed at a first deflection angle θ1 relative to a central or longitudinal axis 225 of bearing mandrel 220 and drill bit 90. In some embodiments, bend adjustment assembly 300 may be locked in the first position 303 until an operator of well system 10 selects to unlock bend adjustment assembly 300 such that assembly 300 may be actuated between the first position 303 and the second and third positions 305, 307, respectively. Additionally, when bend adjustment assembly 300 is in the second position 305, central axis 115 of driveshaft housing 110 may be disposed at a second deflection angle θ2 relative to the central axis 225, where the second deflection angle θ2 may be different from the first deflection angle θ1. Further, when bend adjustment assembly 300 is in the third position 307, central axis 115 of driveshaft housing 110 may be disposed at a third deflection angle θ3 relative to central axis 225, where the third deflection angle θ3 is different from the first deflection angle θ1 and/or the second deflection angle θ2.

In this embodiment, the first deflection angle θ1 is approximately 1.5 degrees, the second deflection angle $\theta_2$ is approximately 0 degrees, and the third deflection angle is approximately 2.1 degrees; however, in other embodiments, each of the deflection angles θ1-θ3 may vary between zero degrees and an acute angle greater than zero. Thus, in this embodiment, when bend adjustment assembly 300 comprises second position 305 and second deflection angle θ2, bend 301 is removed. Additionally, bend adjustment assembly 300 may be configured to actuate between positions 303, 305, and 307 in-situ with BHA 30 disposed in borehole 16. To state in other words, bend adjustment assembly 300 may be downhole-adjustable between the first, second, and third positions 303, 305, and 307, respectively.

Driveshaft 120 of driveshaft assembly 100 has a linear central or longitudinal axis, a first or upper end 120A, and a second or lower end 120B opposite end 120A. Upper end 120A is pivotally coupled to the lower end of rotor 50 via a driveshaft adapter 130 and a first or upper universal joint 140A. Additionally, a lower end 120B of driveshaft 120 is pivotally coupled to an upper end 220A of bearing mandrel 220 with a second or lower universal joint 140B. In this embodiment, upper end 120A of driveshaft 120 and upper universal joint 140A are disposed within driveshaft adapter 130, whereas lower end 120B of driveshaft 120 comprises an axially extending counterbore or receptacle that receives upper end 220A of bearing mandrel 220 and lower universal joint 140B. As best shown in FIG. 7, in this embodiment, the outer surface of driveshaft 120 includes an annular shoulder 122 that receives an annular flow restrictor 123 thereon. As will be described further herein, flow restrictor 123 may be used to provide or communicate a signal from BHA 30 to the surface of borehole 16 following the actuation of bend adjustment assembly 300. In other embodiments, flow restrictor 123 may be integrally formed with driveshaft 120.

Driveshaft adapter 130 of driveshaft assembly 100 extends along a central or longitudinal axis between a first or upper end coupled to rotor 50 (not shown in FIGS. 4, 5, and 7), and a second or lower end coupled to the upper end 120A of driveshaft 120. In this embodiment, the upper end of driveshaft adapter 130 comprises an externally threaded male pin or pin end that threadably engages a mating female box or box end at the lower end of rotor 50. A receptacle or counterbore extends axially from the lower end of adapter 130. The upper end 120A of driveshaft 120 is disposed within the counterbore of driveshaft adapter 130 and pivotally couples to adapter 130 via the upper universal joint 140A disposed within the counterbore of driveshaft adapter 130. Universal joints 140A and 140B allow ends 120A and 120B of driveshaft 120 to pivot relative to adapter 130 and bearing mandrel 220, respectively, while transmitting rotational torque between rotor 50 and bearing mandrel 220. Driveshaft adapter 130 may be coaxially aligned with rotor 50. Since rotor axis 58 is radially offset and/or oriented at an acute angle relative to the central axis 225 of bearing mandrel 220, the central axis of driveshaft 120 may be skewed or oriented at an acute angle relative to axis 115 of housing 110, axis 58 of rotor 50, and a central axis 225 of bearing mandrel 220. However, universal joints 140A and 140B accommodate for the angularly skewed driveshaft 120, while simultaneously permitting rotation of the driveshaft 120 within driveshaft housing 110.

In general, each universal joint (e.g., each universal joint 140A and 140B) may comprise any joint or coupling that allows two parts that are coupled together and not coaxially aligned with each other (e.g., when driveshaft 120 and adapter 130 oriented at an acute angle relative to each other) limited freedom of movement in any direction while transmitting rotary motion and torque. For example, universal joints 140A, 140B may comprise universal joints (Cardan joints, Hardy-Spicer joints, Hooke joints, etc.), constant velocity joints, or any other custom designed joint. In other embodiments, driveshaft assembly 100 may include a flexible shaft comprising a flexible material (e.g., Titanium, etc.) that is directly coupled (e.g., threadably coupled) to rotor 50 of power section 40 in lieu of driveshaft 120, where physical deflection of the flexible shaft (the flexible shaft may have a greater length relative driveshaft 120) accommodates axial misalignment between driveshaft assembly 100 and bearing assembly 200 while allowing for the transfer of torque therebetween.

As previously described, adapter 130 couples driveshaft 120 to the lower end of rotor 50. During drilling operations, high pressure drilling fluid or mud is pumped under pressure from surface pump 23 down drillstring 21 and through cavities 70 between rotor 50 and stator 60, causing rotor 50 to rotate relative to stator 60. Rotation of rotor 50 drives the rotation of driveshaft adapter 130, driveshaft 120, bearing assembly mandrel 220, and drill bit 90. The drilling fluid flowing down drillstring 21 through power section 40 also flows through driveshaft assembly 100 and bearing assembly 200 to drill bit 90, where the drilling fluid flows through nozzles in the face of bit 90 into annulus 18. Within driveshaft assembly 100 and the upper portion of bearing assembly 200, the drilling fluid flows through an annulus 116 formed between driveshaft housing 110 and driveshaft 120.

Figure 6:
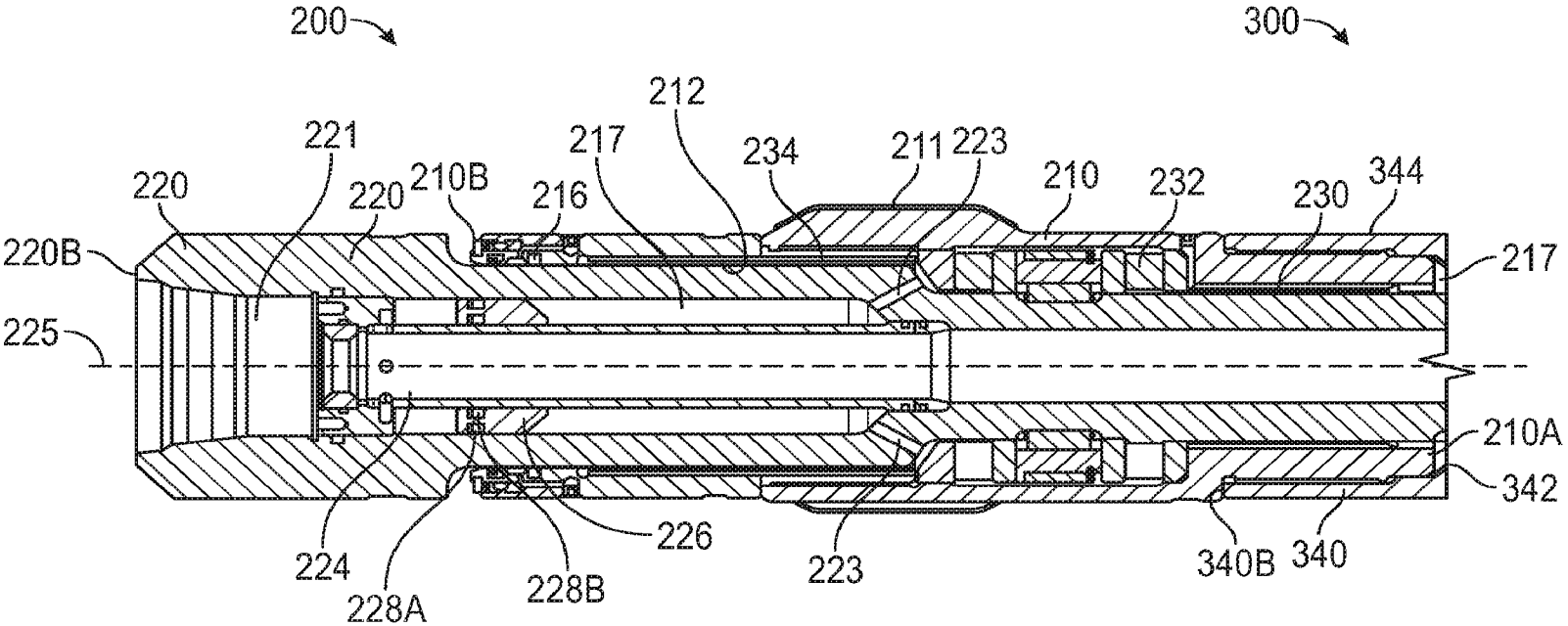
FIG. 6 is a zoomed-in, side cross-sectional view of the bearing assembly of FIG. 4.

Referring to FIGS. 1 and 4-6, the bearing assembly 200 of mud motor 35 is shown in detail in FIG. 6. Bearing assembly 200 may include bearing housing 210 and one-piece (i.e., unitary) bearing mandrel 220 rotatably disposed within housing 210. Bearing housing 210 has a linear central or longitudinal axis disposed coaxial with central axis 225 of mandrel 220, a first or upper end 210A coupled to lower end 110B of driveshaft housing 110 via bend adjustment assembly 300, a second or lower end 210B opposite upper end 210A, and a central through bore or passage extending axially between ends 210A and 210B. In some embodiments, the upper end 210A comprises an externally threaded connector or pin end coupled with bend adjustment assembly 300. Bearing housing 210 may be coaxially aligned with bit 90, however, due to bend 301 between driveshaft assembly 100 and bearing assembly 200, bearing housing 210 may at times be oriented at a non-zero angle relative to driveshaft housing 110. Bearing housing 210 may include a plurality of circumferentially spaced stabilizers 211 extending radially outwards therefrom and configured to stabilize or centralize the position of bearing housing 210 in borehole 16.

In the embodiment of FIGS. 1 and 4-6, bearing mandrel 220 of bearing assembly 200 has a first or upper end 220A, a second or lower end 220B opposite upper end 220A, and a central through passage 221 extending axially from lower end 220B and terminating at a location spaced from both ends 220A, 220B. The upper end 220A of bearing mandrel 220 may be directly coupled to the lower end 120B of driveshaft 120 via lower universal joint 140B. In particular, upper end 220A may be disposed within a receptacle formed in the lower end 120B of driveshaft 120 and pivotally coupled thereto with lower universal joint 140B. Additionally, the lower end 220B of mandrel 220 is coupled to drill bit 90.

In this embodiment, bearing mandrel 220 includes one or more drilling fluid ports 222 extending radially from passage 221 to the outer surface of mandrel 220, and one or more lubrication ports 223 also extending radially from passage 221 to the outer surface of mandrel 220. Drilling fluid ports 222 may be disposed proximal an upper end of passage 221 and lubrication ports 223 may be axially spaced from drilling fluid ports 222. In this arrangement, lubrication ports 223 are separated or sealed from passage 221 of bearing mandrel 220 and the drilling fluid flowing through passage 221. Drilling fluid ports 222 provide fluid communication between annulus 116 and passage 221. During drilling operations, mandrel 220 is rotated about axis 225 relative to housing 210. In particular, high pressure drilling fluid is pumped through power section 40 to drive the rotation of rotor 50, which in turn drives the rotation of driveshaft 120, mandrel 220, and drill bit 90. The drilling fluid flowing through power section 40 flows through annulus 116, drilling fluid ports 222 and passage 221 of mandrel 220 in route to drill bit 90.

In this embodiment, bearing housing 210 has a central bore or passage defined by a radially inner surface 212 that extends between ends 210A and 210B. A lower annular seal 216 is disposed in the inner surface 212 proximal lower end 210B. Additionally, an upper annular seal 218 (shown in FIG. 5) positioned radially between bearing mandrel 220 and an actuator housing 340 of bend adjustment assembly 300 sealingly engages the outer surface of bearing mandrel 220 to define an annular oil or lubricant filled chamber 217 formed radially between the housings 210, 340 and bearing mandrel 220 and extending axially between lower seal 216 and upper seal 218.

Additionally, in this embodiment, bearing mandrel 220 includes a central sleeve 224 disposed in passage 221 and coupled to an inner surface of mandrel 220 defining passage 221. An annular piston 226 is slidably disposed in passage 221 radially between the inner surface of mandrel 220 and an outer surface of sleeve 224, where piston 226 includes a first or outer annular seal 228A that seals against the inner surface of mandrel 220 and a second or inner annular seal 228B that seals against the outer surface of sleeve 224. In this arrangement, chamber 217 extends into the annular space (via lubrication ports 223) formed between the inner surface of mandrel 220 and the outer surface of sleeve 224 that is sealed from the flow of drilling fluid through passage 221 via the annular seals 228A and 228B of piston 226.

In this embodiment, a first or upper radial bearing 230, a thrust bearing assembly 232, and a second or lower radial bearing 234 are each disposed in chamber 217. Upper radial bearing 230 is disposed about mandrel 220 and axially positioned above thrust bearing assembly 232, and lower radial bearing 234 is disposed about mandrel 220 and axially positioned below thrust bearing assembly 232. In general, radial bearings 230, 234 permit rotation of mandrel 220 relative to housing 210 while simultaneously supporting radial forces therebetween. In this embodiment, upper radial bearing 230 and lower radial bearing 234 are both sleeve type bearings that slidingly engage the outer surface of mandrel 220. However, in general, any suitable type of radial bearing(s) may be employed including, without limitation, needle-type roller bearings, radial ball bearings, polycrystalline diamond compact (PDC) radial bearings, or combinations thereof.

Annular thrust bearing assembly 232 is disposed about mandrel 220 and permits rotation of mandrel 220 relative to housing 210 while simultaneously supporting axial loads in both directions (e.g., off-bottom and on-bottom axial loads). In this embodiment, thrust bearing assembly 232 generally comprises a pair of caged roller bearings and corresponding races. In other embodiments, one or more other types of thrust bearings may be included in bearing assembly 200, including ball bearings, planar bearings, PDC thrust bearings, etc. In still other embodiments, the thrust bearing assemblies of bearing assembly 200 may be disposed in the same or different thrust bearing chambers (e.g., two-shoulder or four-shoulder thrust bearing chambers). In this embodiment, radial bearings 230, 234 and thrust bearing assembly 232 are oil-sealed bearings. Particularly, chamber 217 comprises an oil or lubricant filled chamber that is pressure compensated via piston 226. In this configuration, piston 226 equalizes the fluid pressure within chamber 217 with the pressure of drilling fluid flowing through passage 221 of mandrel 220 towards drill bit 90. As previously described, in this embodiment, bearings 230, 232, 234 are oil-sealed. However, in other embodiments, the bearings of the bearing assembly (e.g., bearing assembly 200) are mud lubricated and may comprise hard-faced metal bearings or diamond bearings. In still other embodiments, other features of bearing assembly 200, such as features pertaining to bearing housing 210 and/or bearing mandrel 220 may vary from those shown in FIGS. 4-6.

Referring to FIGS. 1, and 4, 5, and 7-12, the bend adjustment assembly 300 of mud motor 35 is shown in detail in FIGS. 7-12. As previously described, bend adjustment assembly 300 couples driveshaft housing 110 to bearing housing 210, and (at times) introduces bend 301 and deflection angle θ along motor 35. Central axis 115 of driveshaft housing 110 is coaxially aligned with axis 25 of drillstring 21, and central axis 225 of bearing mandrel 220 is coaxially aligned with axis 95 of drill bit 90, thus, deflection angle θ may also represent the angle between axes 115, 225 when mud motor 35 is in an undeflected state (e.g., outside borehole 16).

In some embodiments, bend adjustment assembly 300 is configured to adjust the deflection angle θ between a first predetermined deflection angle $\theta_1$, a second predetermined deflection angle $\theta_2$, different from the first deflection angle $\theta_1$, and a third predetermined deflection angle $\theta_3$, different from the first deflection angle $\theta_1$ and second deflection angle $\theta_2$, with drillstring 21 and BHA 30 in-situ disposed in borehole 16. In other words, bend adjustment assembly 300 is configured to adjust the amount of bend 301 without needing to pull drillstring 21 from borehole 16 to adjust bend adjustment assembly 300 at the surface, thereby reducing the amount of time required to drill borehole 16. In other embodiments, bend adjustment assembly 300 may only be configured to adjust the deflection angle θ between a two different predetermined deflection angles θ. In the embodiment of FIGS. 1, 4, 5, and 7-12, first predetermined deflection angle $\theta_1$ is equal to approximately 1.5°, second deflection angle $\theta_2$ is equal to approximately 0°, and third deflection angle $\theta_3$ is equal to approximately 2.1°; however, in other embodiments, each of deflection angles $\theta_1$-$\theta_3$ may vary. For example, in other embodiments, second deflection angle $\theta_2$ may be greater than zero and one or both of first deflection angle $\theta_1$ and second deflection angle $\theta_2$ may be equal to approximately 0°.

In this embodiment, bend adjustment assembly 300 generally includes a first or upper housing 310, a second or lower housing 320, and a locker or actuator housing 340, a piston mandrel 350, a first or upper adjustment mandrel 360, a second or lower adjustment mandrel 370, and a locking piston 380. Upper housing 310 and lower housing 320 may also be referred to herein as upper offset housing 310 and lower offset housing 320.

As shown particularly in FIG. 7, upper housing 310 is generally tubular and has a first or upper end 310A, a second or lower end 310B opposite upper end 310A, and a central bore or passage defined by a generally cylindrical inner surface 312 extending between ends 310A and 310B. In this embodiment, upper housing 310 comprises a plurality of tubular members coupled at sealed threaded connections, however, in other embodiments, upper housing 310 may comprise a single, integrally or monolithically formed tubular member. The inner surface 312 of upper housing 310 includes an engagement surface 314 extending from upper end 310A and a threaded connector 316 extending from lower end 310B. An annular seal 318 is disposed radially between engagement surface 314 of upper housing 310 and an outer surface of upper adjustment mandrel to seal the annular interface formed therebetween.

Figure 9:
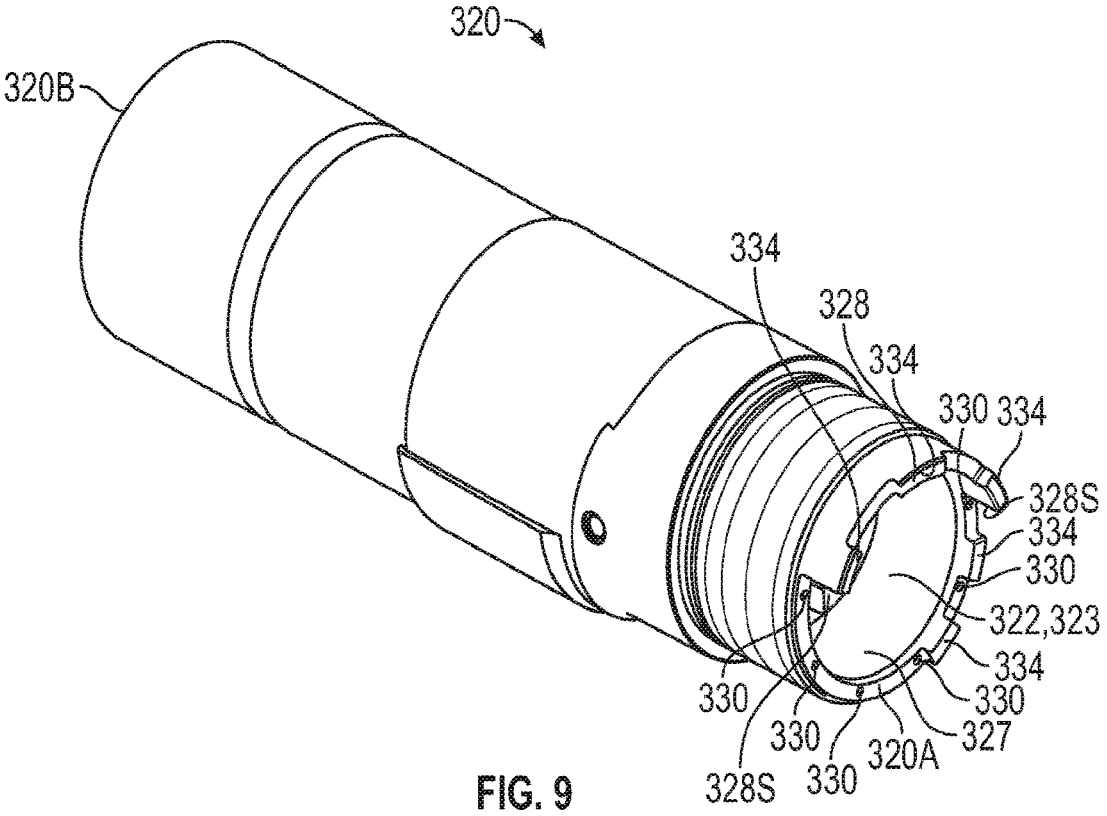
FIG. 9 is a perspective view of a lower housing of the bend adjustment assembly of FIG. 4 according to some embodiments.

As shown particularly in FIGS. 7, 9, the lower housing 320 of bend adjustment assembly 300 is generally tubular and has a first or upper end 320A, a second or lower end 320B opposite upper end 320A, and a generally cylindrical inner surface 322 extending between ends 320A and 320B. A generally cylindrical outer surface of lower housing 320 includes a threaded connector coupled to the threaded connector 316 of upper housing 310. The inner surface 322 of lower housing 320 includes an offset engagement surface 323 extending from upper end 320A, and a threaded connector 324 (shown in FIG. 5) extending from lower end 320B. In this embodiment, offset engagement surface 323 defines an offset bore or passage 327 (shown in FIG. 7) that extends from upper end 320A of lower housing 320. Additionally, lower housing 320 includes a central bore or passage 329 (shown in FIG. 7) extending from lower end 320B, where central bore 329 has a central axis disposed at a non-zero angle relative to a central axis of offset bore 327. In other words, offset engagement surface 323 has a central or longitudinal axis that is offset or disposed at a non-zero angle relative to a central or longitudinal axis of lower housing 320. Thus, the offset or angle formed between central bore 329 and offset bore 327 of lower housing 320 facilitates the selective formation of bend 301 described above.

As shown particularly in FIG. 9, in this embodiment, lower housing 320 of bend adjustment assembly 300 includes an arcuate lip or extension 328 formed at upper end 320A. Particularly, extension 328 extends arcuately between a pair of axially extending shoulders 328S. In this embodiment, extension 328 extends less than 180° about the central axis of lower housing 320; however, in other embodiments, the arcuate length or extension of extension 328 may vary. Additionally, the upper end 320A of lower housing 320 comprises a plurality of circumferentially spaced protrusions or castellations 334. Castellations 334 are spaced substantially about the circumference of the upper end 320A of lower housing 320, and may be formed on the portion of the circumference of upper end 320A comprising extension 328 as well as the portion of the circumference of upper end 320A which is arcuately spaced from extension 328. Castellations 334 may be circumferentially spaced uniformly about a circumference of lower housing 320; alternatively, castellations 334 may only be positioned along a portion of the circumference of lower housing 320.

As will be described further herein, castellations 334 of lower housing 320 are configured to lock lower housing 320 with lower adjustment mandrel 370 to selectably restrict rotation therebetween. Further, lower housing 320 includes a plurality of circumferentially spaced and axial ports 330 that extend axially between upper end 320A and lower end 320B. As will be discussed further herein, axial ports 330 of lower housing 320 provide fluid communication through a generally annular compensation or locking chamber 395 (shown in FIG. 7) of bend adjustment assembly 300.

Referring still to FIGS. 1, and 4, 5, and 7-12, actuator housing 340 of bend adjustment assembly 300 houses the actuator assembly 400 of bend adjustment assembly 300 and couples bend adjustment assembly 300 with bearing assembly 200. Actuator housing 340 is generally tubular and has a first or upper end 340A, a second or lower end 340B opposite upper end 340A, and a central bore or passage defined by a generally cylindrical inner surface 342 extending between ends 340A and 340B. In this embodiment, a generally cylindrical outer surface of actuator housing 340 includes a threaded connector at upper end 340A that is coupled with the threaded connector 324 of lower housing 320. In this embodiment, the inner surface 342 of actuator housing 340 includes a threaded connector 344 (shown in FIG. 5) at lower end 340B, an annular shoulder 346 (shown in FIG. 8), and a radial port 347 (shown in FIGS. 5, 8) that extends radially between inner surface 342 and the outer surface of actuator housing 340.

Threaded connector 344 of actuator housing 340 may couple with a corresponding threaded connector disposed on an outer surface of bearing housing 210 at the upper end 210A of bearing housing 210 to thereby couple bend adjustment assembly 300 with bearing assembly 200. In this embodiment, the inner surface 342 of actuator housing 340 additionally includes an annular seal 348 (shown in FIG. 8) located proximal shoulder 346 and a plurality of circumferentially spaced and axially extending slots or grooves 349 (shown in FIG. 10). As will be discussed further herein, seal 348 and slots 349 are configured to interface with components of actuator assembly 400.

As shown particularly in FIG. 7, piston mandrel 350 of bend adjustment assembly 300 is generally tubular and has a first or upper end 350A, a second or lower end 350B opposite upper end 350A, and a central bore or passage extending between ends 350A and 350B. Additionally, piston mandrel 350 includes a generally cylindrical outer surface comprising a threaded connector 351 and an annular seal 352. In other embodiments, piston mandrel 350 may not include connector 351. Threaded connector 351 extends from lower end 350B while annular seal 352 is located at upper end 350A that sealingly engages the inner surface of driveshaft housing 110. Further, piston mandrel 350 includes an annular shoulder 353 located proximal upper end 350A that physically engages or contacts an annular biasing member 354 extending about the outer surface of piston mandrel 350. In this embodiment, an annular compensating piston 356 is slidably disposed about the outer surface of piston mandrel 350. Compensating piston 356 includes a first or outer annular seal 358A disposed in an outer cylindrical surface of piston 356, and a second or inner annular seal 358B disposed in an inner cylindrical surface of piston 356, where inner seal 358B sealingly engages the outer surface of piston mandrel 350.

Also as shown particularly in FIG. 7, upper adjustment mandrel 360 of bend adjustment assembly 300 is generally tubular and has a first or upper end 360A, a second or lower end 360B opposite upper end 360A, and a central bore or passage defined by a generally cylindrical inner surface extending between ends 360A and 360B. In this embodiment, the inner surface of upper adjustment mandrel 360 includes an annular seal 362 configured to sealingly engage the outer surface of piston mandrel 350. In this embodiment, the inner surface of upper adjustment mandrel 360 additionally includes a threaded connector 363 coupled with a threaded connector on the outer surface of piston mandrel 350 at the lower end 350B thereof. In other embodiments, upper adjustment mandrel 360 may not include connector 363. Outer seal 358A of compensating piston 356 sealingly engages the inner surface of upper adjustment mandrel 360, restricting fluid communication between locking chamber 395 and a generally annular compensating chamber 359 formed about piston mandrel 350 and extending axially between seal 352 of piston mandrel 350 and outer seal 358A of compensating piston 356. In this configuration, compensating chamber 359 is in fluid communication with the surrounding environment (e.g., borehole 16) via ports (hidden in FIG. 7) formed in driveshaft housing 110.

In this embodiment, upper adjustment mandrel 360 includes a generally cylindrical outer surface comprising a first or upper threaded connector 364, an offset engagement surface 365, and an outer sleeve 366 that forms an annular shoulder 368. Outer sleeve 366 is axially and rotationally locked to upper adjustment mandrel 360. Additionally, outer sleeve 366 is rotationally locked with lower adjustment mandrel 370 such that relative rotation between upper adjustment mandrel 360 and lower adjustment mandrel 370 is restricted. However, a limited degree of relative axial movement is permitted between outer sleeve 366 and lower adjustment mandrel 370, as will be described further herein. Upper threaded connector 364 of upper adjustment mandrel 360 extends from upper end 360A and may couple to a threaded connector disposed on the inner surface of driveshaft housing 110 at lower end 110B. Offset engagement surface 365 has a central or longitudinal axis that is offset from or disposed at a non-zero angle relative to a central or longitudinal axis of upper adjustment mandrel 360. Offset engagement surface 365 matingly engages the engagement surface 314 of upper housing 310, as will be described further herein. In this embodiment, the outer surface of upper offset mandrel 360 proximal lower end 360B includes an annular seal 367 that sealingly engages lower adjustment mandrel 370.

Figure 11:
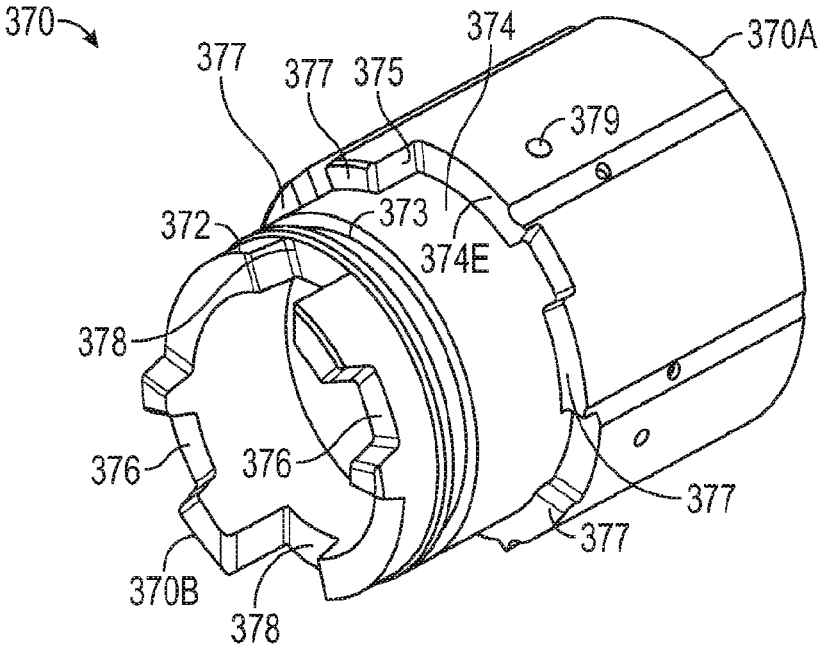
FIG. 11 is a perspective view of a lower adjustment mandrel of the bend adjustment assembly of FIG. 4 according to some embodiments.

As shown particularly in FIGS. 7, 11, lower adjustment mandrel 370 of bend adjustment assembly 300 is generally tubular and has a first or upper end 370A, a second or lower end 370B opposite upper end 370A, and a central bore or passage extending therebetween that is defined by a generally cylindrical inner surface. In this embodiment, the inner surface of lower adjustment mandrel 370 includes one or more members (e.g., pins, splines, etc.) in engagement with the outer sleeve 366 of upper adjustment mandrel 360 to restrict relative rotational movement while permitting relative axial movement therebetween. Additionally, lower adjustment mandrel 370 includes a generally cylindrical outer surface comprising an offset engagement surface 372, an annular seal 373, and an arcuately extending recess 374. Offset engagement surface 372 has a central or longitudinal axis that is offset or disposed at a non-zero angle relative to a central or longitudinal axis of the upper end 360A of upper adjustment mandrel 360 and the lower end 320B of lower housing 320, where offset engagement surface 372 is disposed directly adjacent or overlaps the offset engagement surface 323 of lower housing 320.

In this embodiment, when bend adjustment assembly 300 is disposed in the first position 303, a first deflection angle is provided between the central axis of lower housing 320 and the central axis of upper adjustment mandrel 360, when bend adjustment assembly 300 is disposed in the second position 305, a second deflection angle is provided between the central axis of lower housing 320 and the central axis of upper adjustment mandrel 360 that is different from the first deflection angle, and when bend adjustment assembly 300 is disposed in the third position 307, a third deflection angle is provided between the central axis of lower housing 320 and the central axis of upper adjustment mandrel 360 that is different from both the first deflection angle and the second deflection angle.

Annular seal 373 of lower adjustment mandrel 370 is disposed in the outer surface of lower adjustment mandrel 370 to sealingly engage the inner surface of lower housing 320. Arcuate recess 374 of lower adjustment mandrel 370 is defined by an inner terminal end or arcuate shoulder 374E and a pair of circumferentially spaced axially extending shoulders 375. Lower adjustment mandrel 370 also includes a pair of circumferentially spaced first or short slots 376 and a pair of circumferentially spaced second or long slots 378, where both short slots 376 and long slots 378 extend axially into lower adjustment mandrel 370 from lower end 370B. In this embodiment, each short slot 376 is circumferentially spaced approximately 180° apart. Similarly, in this embodiment, each long slot 378 is circumferentially spaced approximately 180° apart; however, in other embodiments, the circumferential spacing of short slots 376 and long slots 378 may vary.

In this embodiment, the lower end 370B of lower adjustment mandrel 370 further includes a plurality of circumferentially spaced protrusions or castellations 377 configured to matingly or interlockingly engage the castellations 334 formed at the upper end 320A of lower housing 320. Castellations 377 are spaced substantially about the circumference of lower adjustment mandrel 370, and may be formed on the portion of the circumference of lower adjustment mandrel 370 comprising recess 374 as well as the portion of the circumference of lower adjustment mandrel 370 which is arcuately spaced from recess 374. Castellations 377 may be circumferentially spaced uniformly about a circumference of lower adjustment mandrel 370; alternatively, castellations 377 may only be positioned along a portion of the circumference of lower adjustment mandrel 370.

In some embodiments, lower adjustment mandrel 370 comprises a first or lower axial position (shown in FIG. 7) relative lower housing 320 and upper adjustment mandrel 360, and a second or upper axial position relative lower housing 320 and upper adjustment mandrel 360 which is axially spaced from the lower axial position. When lower adjustment mandrel 370 is in the lower axial position, castellations 377 of lower adjustment mandrel 370 may interlock with castellations 334 of lower housing 320, restricting relative rotation therebetween. In this configuration, bend adjustment assembly 300 may be operated by an operator of well system 10 as a bend assembly that provides a fixed bend and thus may operate drillstring 21 and BHA 30 as desired without inadvertently actuating bend assembly 300 between positions 303, 305, and 307. For example, with lower adjustment mandrel 370 disposed in the lower axial position, rotation of drillstring 21 and/or the flow of drilling fluid at a drilling flowrate through bend adjustment assembly 300 will not unlock or otherwise actuate bend adjustment assembly 300 from the first position 303 to either the second position 305 or third position 307 given the interlocking engagement between castellations 334 of lower housing 320 with castellations 377 of lower adjustment mandrel 370. However, when lower adjustment mandrel 370 is in the upper axial position, castellations 377 of lower adjustment mandrel 370 are axially spaced and disengaged from castellations 334 of lower housing 320, permitting relative rotation therebetween. As will be described further herein, in some embodiments, lower adjustment mandrel 370 is initially retained in the lower axial position via a shear pin or member 379 and lower adjustment mandrel 370 is actuatable downhole or in-situ from the lower axial position to the upper axial position.

Figure 12:
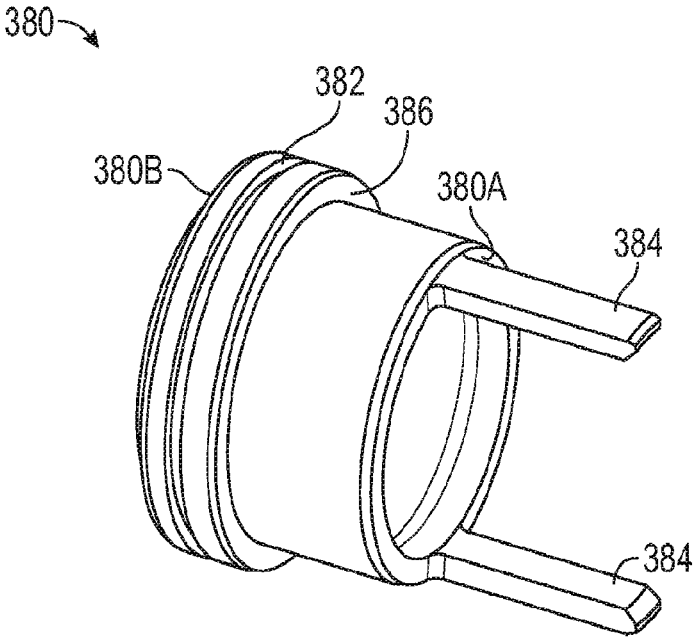
FIG. 12 is a perspective view of a locking piston of the bend adjustment assembly of FIG. 4 according to some embodiments

As shown particularly in FIGS. 7, 12, locking piston 380 of bend adjustment assembly 300 is generally tubular and has a first or upper end 380A, a second or lower end 380B opposite upper end 380A, and a central bore or passage extending therebetween. Locking piston 380 includes a generally cylindrical outer surface comprising a pair of annular seals 382 (only one of which is shown in FIG. 12) disposed therein, one annular seal 382 positioned at each end 380A, 380B of locking piston 380. In this embodiment, locking piston 380 includes a pair of circumferentially spaced keys 384 that extend axially from upper end 380A, where each key 384 may extend through one of the circumferentially spaced slots 331 of lower housing 320. In this configuration, relative rotation between locking piston 380 and lower housing 320 is restricted while relative axial movement is permitted therebetween. As will be discussed further herein, each key 384 is receivable in either the pair of short slots 376 or pair of long slots 378 of lower adjustment mandrel 370 depending on the relative angular position between locking piston 380 and lower adjustment mandrel 370. Additionally, the outer surface of locking piston 380 may include an annular shoulder 386 located between ends 380A and 380B.

Referring still to FIGS. 1, and 4, 5, and 7-12, the sealing engagement between seals 382 of locking piston 380 and the inner surface 322 of lower housing 320 defines a lower axial end of locking chamber 395. In this configuration, locking chamber 395 extends longitudinally from the lower axial end thereof (defined by seals 382) to an upper axial end defined by the combination of sealing engagement between the outer seal 358A of compensating piston 356 and the inner seal 358B of piston 356. Particularly, lower adjustment mandrel 370 and upper adjustment mandrel 360 each include axially extending ports similar in configuration to the axial ports 330 of lower housing 320 such that fluid communication is provided between the annular space directly adjacent shoulder 386 of locking piston 380 and the annular space directly adjacent a lower end of compensating piston 356. For example, upper adjustment mandrel 360 includes one or more ports 369 (shown in FIG. 7) in fluid communication with axial ports 330. Locking chamber 395 is sealed from annulus 116 such that drilling fluid flowing into annulus 116 is not permitted to communicate with fluid disposed in locking chamber 395, where locking chamber 395 is filled with lubricant.

Figure 8:
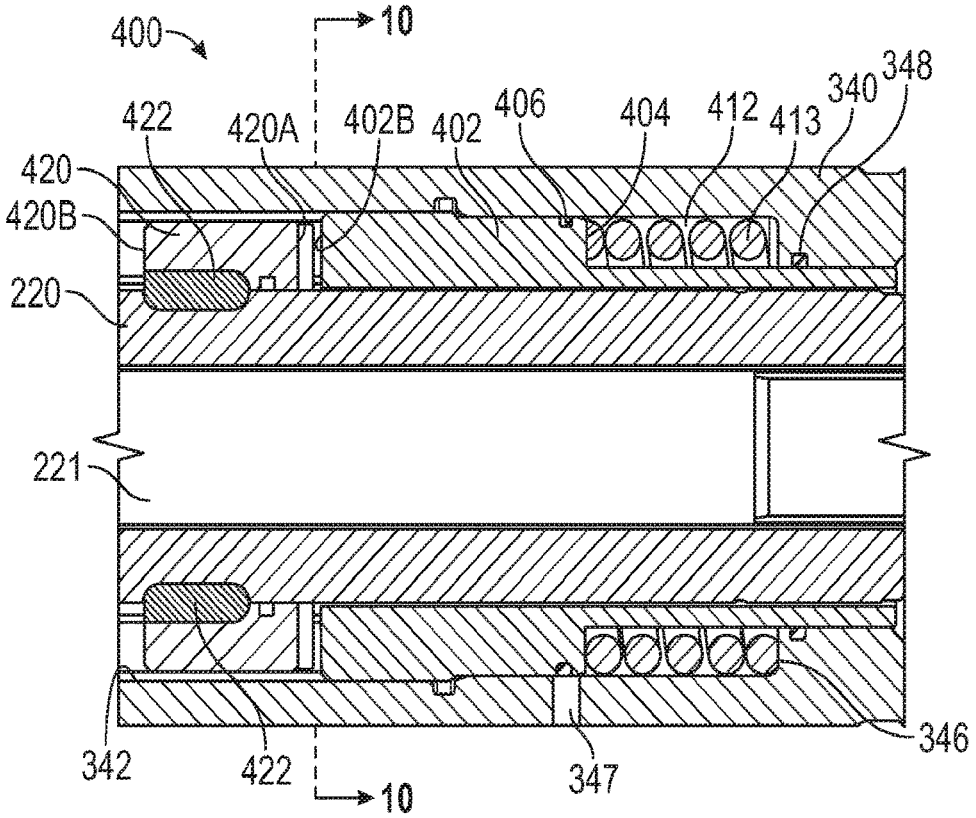
FIG. 8 is a zoomed-in, side cross-sectional view of an actuator assembly of the bearing assembly of FIG. 4 according to some embodiments.
Figure 10:
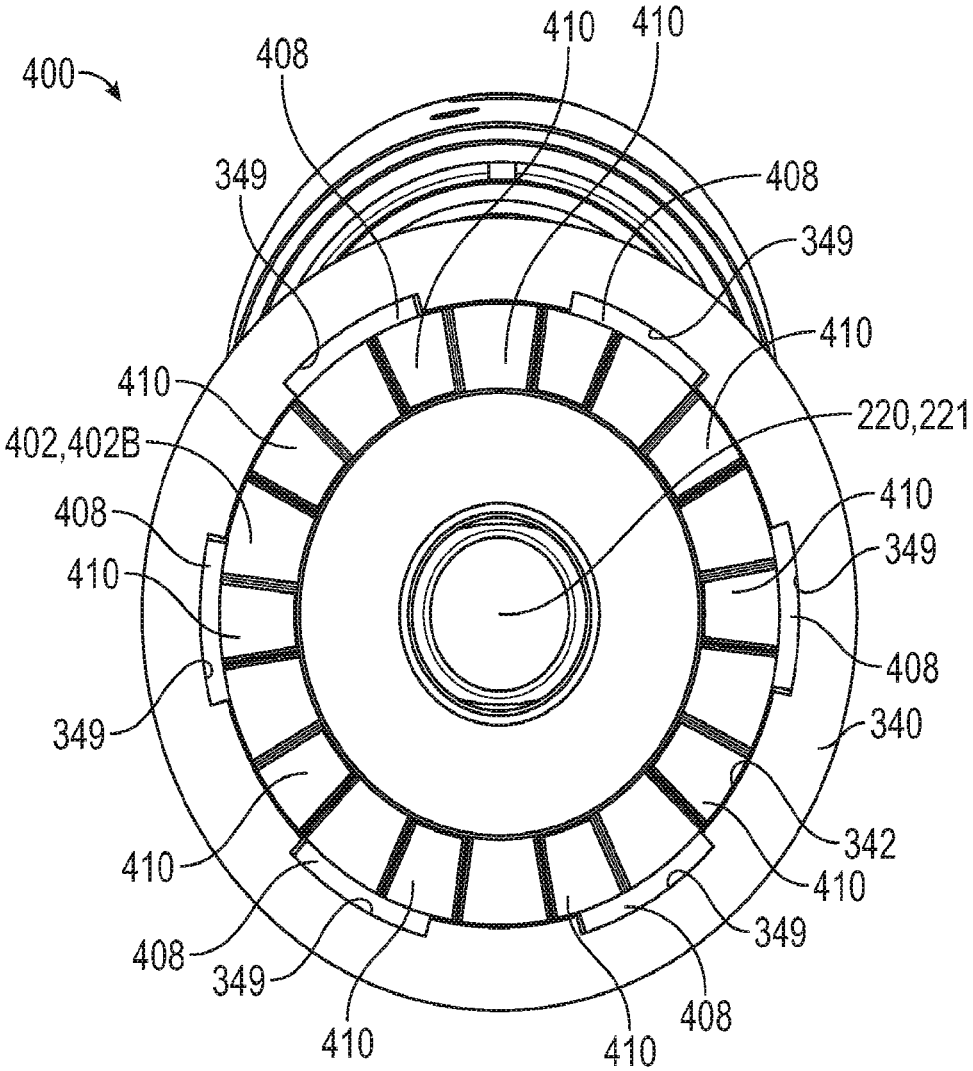
FIG. 10 is a cross-sectional view of the mud motor of FIG. 4 along line 10-10 of FIG. 8.

As shown particularly in FIGS. 8, 10, actuator assembly 400 of bend adjustment assembly 300 generally includes an actuator piston 402 and a torque transmitter or teeth ring 420. Actuator piston 402 is slidably disposed about bearing mandrel 220 and has a first or upper end 402A, a second or lower end 402B opposite upper end 402A, and a central bore or passage extending therebetween. In this embodiment, actuator piston 402 has a generally cylindrical outer surface including an annular shoulder 404 and an annular seal 406 positioned thereon and located axially between shoulder 404 and lower end 402B. As shown particularly in FIG. 10, the outer surface of actuator piston 402 includes a plurality of radially outwards extending and circumferentially spaced keys 408 received in the slots 349 of actuator housing 340. In this arrangement, actuator piston 402 is permitted to slide axially relative actuator housing 340 while relative rotation between actuator housing 340 and actuator piston 402 is restricted, thereby allowing for the transfer of torque between piston 402 and actuator housing 340. Additionally, in this embodiment, actuator piston 402 includes a plurality of circumferentially spaced locking teeth 410 extending axially from lower end 402B. In some embodiments, actuator assembly 400 is configured similarly as the actuator assembly 400 described in U.S. Pat. No. 10,337,251, which is incorporated herein by reference in its entirety for all purposes.

Seal 406 of actuator piston 402 sealingly engages the inner surface 342 of actuator housing 340 and the seal 348 of actuator housing 340 sealingly engages the outer surface of actuator piston 402 to form an annular, sealed compensating chamber 412 extending axially therebetween. Fluid pressure within compensating chamber 412 is compensated or equalized with the surrounding environment (e.g., borehole 16) via radial port 347 of actuator housing 340. Additionally, an annular biasing member or element 413 is disposed within compensating chamber 412 and applies a biasing force against shoulder 404 of actuator piston 402 in the axial direction of teeth ring 420. Teeth ring 420 of actuator assembly 400 is generally tubular and comprises a first or upper end 420A, a second or lower end 420B opposite upper end 420A, and a central bore or passage extending between ends 420A and 420B. Teeth ring 420 is coupled to bearing mandrel 220 via a plurality of circumferentially spaced splines or pins 422 disposed radially therebetween. In this arrangement, relative axial and rotational movement between bearing mandrel 220 and teeth ring 420 is restricted and torque may be transferred between bearing mandrel 220 and teeth ring 420. In this embodiment, teeth ring 420 comprises a plurality of circumferentially spaced teeth 424 extending from upper end 420A. Teeth 424 of teeth ring 420 are configured to matingly engage or mesh with the teeth 410 of actuator piston 402 when biasing member 413 biases actuator piston 402 into contact with teeth ring 420, as will be discussed further herein.

In this embodiment, actuator assembly 400 is both mechanically and hydraulically biased during operation of mud motor 35. Additionally, the driveline of mud motor 35 is independent of the operation of actuator assembly 400 while drilling, thereby permitting transfer of substantially 100% of the available torque provided by power section 40 to power drill bit 90 when actuator assembly 400 is disengaged whereby teeth ring 420 is not engaged with piston 402. The disengagement of actuator assembly 400 may occur at high flowrates through mud motor 35, and thus, when higher hydraulic pressures are acting against actuator piston 402. In this configuration, actuator assembly 400 comprises a selective auxiliary drive that is simultaneously both mechanically and hydraulically biased. Further, this configuration of actuator assembly 400 allows for various levels of torque to be applied as the hydraulic effect can be used to effectively reduce the preload force of biasing member 413 acting on mating teeth ring 420. This type of angled tooth clutch may be governed by the angle of the teeth (e.g., teeth 424 of teeth ring 420), the axial force applied to keep the teeth in contact, the friction of the teeth ramps, and the torque engaging the teeth to determine the slip torque that is required to have the teeth slide up and turn relative to each other.

In some embodiments, actuator assembly 400 permits rotation in mud motor 35 to rotate rotor 50 and bearing mandrel 220 until bend adjustment assembly 300 has fully actuated, and then, subsequently, ratchet or slip while transferring relatively large amounts of torque to bearing housing 210. This reaction torque may be adjusted by increasing the hydraulic force or hydraulic pressure acting on actuator piston 402, which may be accomplished by increasing flowrate through mud motor 35. When additional torque is needed a lower flowrate or fluid pressure can be applied to actuator assembly 400 to modulate the torque and thereby rotate bend adjustment assembly 300. The fluid pressure is transferred to actuator piston 402 by compensating piston 226. In some embodiments, the pressure drop across drill bit 90 may be used to increase the pressure acting on actuator piston 402 as flowrate through mud motor 35 is increased.

Referring now to FIGS. 13-17, having described the structure of embodiments of driveshaft assembly 100, bearing assembly 200, and bend adjustment assembly 300, an embodiment for operating assemblies 100, 200, and 300 will now be described. As described above, bend adjustment assembly 300 includes first position 303 (shown in FIGS. 7, 13) providing first deflection angle θ1, a second position 305 (shown in FIGS. 14, 15) providing second deflection angle θ2, and a third position 307 (shown in FIGS. 16, 17) providing third deflection angle θ3. As will be described further herein, in this embodiment, bend adjustment assembly 300 is configured to be locked into first position 303 until an operator of well system 10 selects to shift from the first position 303 to the second position 305 in response to applying a sufficient pressure force to shear the shear pin 379 and thereby displace lower adjustment mandrel 370 from the lower axial position to the upper axial position, subsequently allowing for rotation of lower housing 320 in a first direction relative to lower adjustment mandrel 370. Thus, the first position 303 may comprise an initial position of bend adjustment assembly 300. With lower adjustment mandrel 370 in the upper axial position, bend adjustment assembly 300 may also be configured to shift from the second position 305 to the third position 307 in response to rotation of lower housing 320 in a second direction relative to lower adjustment mandrel 370 that is opposite the first direction. Bend adjustment assembly 300 may further be configured to actuate or toggle between the second and third positions 305, 307 a substantially unlimited number of times with the lower adjustment mandrel 370 in the axially lower position.

As described above, bend adjustment assembly 300 may behave similar to a bend assembly having a fixed bend when lower adjustment mandrel 370 is in the lower axial position, permitting an operator greater flexibility (e.g., a the opportunity to vary a flowrate of drilling fluid delivered to mud motor 35 to a greater degree) in operating BHA 35 with bend adjustment assembly 300 in this "fixed" or "locked" bend configuration with lower adjustment assembly 370 in the lower axial position. Only when it is desired by the operator to vary the bend 301 along bend adjustment assembly 300 may the operator selectably actuate the bend adjustment assembly 300 from the fixed bend configuration to a variable bend configuration with lower adjustment mandrel 370 in the axially upper position whereby the bend adjustment assembly may be selectably toggled between the second and third positions 305, 307 for as many times as desired by the operator.

In this embodiment, bend adjustment assembly 300 may be actuated between positions 303, 305, and 307 via rotating the offset housings 310 and 320 relative to the adjustment mandrels 360 and 370 in response to varying a flowrate of drilling fluid through annulus 116 and/or varying the degree of rotation of drillstring 21 at the surface. Particularly, locking piston 380 includes a first or locked position restricting relative rotation between the offset housings 310, 320 and the adjustment mandrels 360, 370, and a second or unlocked position axially spaced from the locked position that does not prevent relative rotation between the housings 310, 320 and the adjustment mandrels 360, 370. In the locked position of locking piston 380 (shown in FIGS. 15, 17), keys 384 are received in either the pair of short slots 376 (shown in FIG. 17) or the pair of long slots 378 of lower adjustment mandrel 370 (shown in FIG. 15), thereby restricting relative rotation between locking piston 380, which is not permitted to rotate relative lower housing 320, and lower adjustment mandrel 370. In the unlocked position of locking piston 380, keys 384 of locking piston 380 are not received in either the pair of short slots 376 or the pair of long slots 378 of lower adjustment mandrel 370, and thus, rotation between lower housing 320 and lower adjustment mandrel 370 is not prevented by locking piston 380. While interlocking engagement between castellations 334 of lower housing 320 with castellations 377 of lower adjustment mandrel 370 may lock the position of bend adjustment assembly 300 when assembly 300 is in the fixed bend configuration (lower adjustment mandrel 370 being in the lower axial position), locking piston 380 may allow for the selective retaining of the bend adjustment assembly 300 in either the second position 305 or third position 307 when assembly 300 is in the variable bend configuration (lower adjustment mandrel 370 being in the upper axial position).

Additionally, in this embodiment, bearing housing 210, actuator housing 340, lower housing 320, and upper housing 310 are threadably connected to each other. Similarly, lower adjustment mandrel 370, upper adjustment mandrel 360, and driveshaft housing 110 are each splined or threadably connected to each other in this embodiment. Thus, relative rotation between offset housings 310, 320, and adjustment mandrels 360, 370, results in relative rotation between bearing housing 210 and driveshaft housing 110.

In some embodiments, bend adjustment assembly 300 includes a fluid metering assembly 500 (shown in FIG. 15 and hidden in FIG. 17) generally including an annular seal carrier 502 and an annular seal body 510, each disposed around the locking piston 380 of bend adjustment assembly 300. An outer surface of seal carrier 502 includes a plurality of flow channels extending between opposing ends thereof, and an inner surface of seal carrier 502 receives an annular seal configured to sealingly engage a detent or upset formed on the outer surface of locking piston 380. Seal body 510 has an outer surface that receives an annular seal configured to sealingly engage the inner surface 322 of lower housing 320. Seal body 510 also includes an inner surface which comprises a plurality of circumferentially spaced flow channels extending between opposing ends thereof. Additionally, an upper end of seal body 510 defines a seal endface 504 configured to sealingly engage a seal endface defined by a lower end of seal carrier 502. Further, endface 504 of seal body 510 includes a plurality of metering channels extending between the outer surface and the inner surface of seal body 510. In some embodiments, fluid metering assembly 500 is configured similarly as the fluid metering assembly 760 described in U.S. patent application Ser. No. 16/398,158, which is incorporated herein by reference in its entirety for all purposes.

Fluid metering assembly 500 is generally configured to retard, delay, or limit the actuation of locking piston 380 between the unlocked and locked positions in at least one axial direction. Particularly, the fluid metering assembly 500 limits or delays the movement of locking piston 380 through the detent of locking piston 380 that sealing engages seal carrier 502 when locking piston 380 is actuated via a change in flowrate or pressure across the downhole adjustable bend assembly 300. Particularly, in this embodiment, when locking piston 380 is actuated from the unlocked position to the locked position, seal carrier 502 is axially spaced from seal body 510, permitting fluid within locking chamber 395 to flow freely between the endfaces of seal carrier 502 and seal body 510, respectively.

However, in this embodiment, when locking piston 380 is actuated from the locked position to the unlocked position, the endface of seal carrier 502 sealingly engages the endface 504 of seal body 510. In this configuration, fluid within locking chamber 395 may only travel between the endfaces of seal carrier 502 and seal body 510, respectively, via the metering channels of seal body 510, thereby restricting or metering fluid flow between seal carrier 502 and seal body 510. The flow restriction created between seal carrier 502 and seal body 510 in this configuration retards or delays the axial movement of locking piston 380 from the locked position to the unlocked position.

In addition, as described above, lower adjustment mandrel 370 has a lower axial position and an upper axial position axially spaced from the lower axial position relative lower housing 320. As described above, in the lower axial position of lower adjustment mandrel 370, castellations 377 of lower adjustment mandrel 370 interlock with castellations 334 of lower housing 320, thereby restricting relative rotation between adjustment mandrels 360, 370 relative housings 310, 320 irrespective of the position of locking piston 380. Thus, bend adjustment assembly 300 may only actuate between second position 305 and third position 307 once a predefined operation has been performed by the operator of well system 10 to actuate bend adjustment assembly 300 from the fixed bend configuration to the variable bend configuration (shifting lower adjustment mandrel 370 from the lower axial position to the upper axial position). Further, when lower adjustment mandrel 370 is in the lower axial position, each shoulder 328S of the extension 328 of lower housing 320 is arcuately or angularly spaced from each of the shoulders 375 defining recess 374. Thus, when lower adjustment mandrel 370 is in the lower axial position, torque transferred from drillstring 21 to lower adjustment mandrel 370 via driveshaft housing 110 and upper adjustment mandrel 360, is transferred from lower adjustment mandrel 370 to lower housing 320 entirely via the interlocking engagement between castellations 334, 377, and without relying on contact between shoulders 375 of lower adjustment mandrel 370 and shoulders 328S of lower housing 320. Thus, in this embodiment, castellations 334, 377 are numerous enough to provide sufficient contact area (so as not to overstress the mandrel 370 and/or housing 320) for transmitting drilling torque from drillstring 21 between lower adjustment mandrel 370 and lower housing 320.

As described above, offset bore 327 and offset engagement surface 323 of lower housing 320 are offset from central bore 329 and the central axis of housing 320 to form a lower offset angle, and offset engagement surface 365 of upper adjustment mandrel 360 is offset from the central axis of mandrel 360 to form an upper offset angle. Additionally, offset engagement surface 323 of lower housing 320 matingly engages the engagement surface 372 of lower adjustment mandrel 370 while the engagement surface 314 of upper housing 310 matingly engages the offset engagement surface 365 of upper adjustment mandrel 360. In this arrangement, the relative angular position between lower housing 320 and lower adjustment mandrel 370 determines the total offset angle (ranging from 0° to a maximum angle greater than 0°) between the central axes of lower housing 320 and driveshaft housing 110. The minimum angle (0° in this embodiment) occurs when the upper and lower offsets are in-plane and cancel out, while the maximum angle occurs when the upper and lower offsets are in-plane and additive. Therefore, by adjusting the relative angular positions between offset housings 310, 320, and adjustment mandrels 360, 370, the deflection angle θ and bend 301 of bend adjustment assembly 300 may be adjusted or manipulated in-turn.

The magnitudes of deflection angle θ in positions 305, and 307 (e.g., the magnitudes of deflection angles $\theta_2$ and $\theta_3$) are controlled by the relative positioning of shoulders 328S of lower housing 320 and shoulders 375 of lower adjustment mandrel 370, which establish the extents of angular rotation in each direction. In this embodiment, lower housing 320 is provided with a fixed amount of spacing between shoulders 328S, while adjustment mandrel 370 can be configured with an optional amount of spacing between shoulders 375, allowing the motor to be set up with the desired bend setting options ($\theta_2$ and $\theta_3$) as dictated by a particular application simply by providing the appropriate configuration of lower adjustment mandrel 370. However, given that shoulders 328S of lower housing 320 are spaced from each shoulder 375 of lower adjustment mandrel 370 when bend adjustment assembly 300 is in the first position 303, first deflection angle θ1 is not defined by relative positioning of shoulders 328S and shoulders 375, and instead is defined by the relative angular positioning of castellations 334 of lower housing 320 and castellations 377 of lower adjustment mandrel 370. In other words, the angular positioning of castellations 334, 377 define the relative angular positions of lower adjustment mandrel 370 and lower housing 320 when bend adjustment assembly 300 is in the first position 303, where the relative angular positioning of housing 320 and mandrel 370 when assembly 300 is in the first position 303 varies from the relative angular positioning of housing 320 and mandrel 370 when assembly 300 is in either of positions 305, 307.

In this embodiment, well system 10 may initially be operated in a straight-drilling mode whereby drillstring 21 is rotated at the surface by rotary system 24, and rotation of drillstring 21 is transmitted to drill bit 90 to thereby drill into formation 5 and extend borehole 16. At some point during the drilling of borehole 16 it may be desired to switch from the straight-drilling mode of operation to a directional-drilling mode of operation for forming a deviated or curved portion of borehole 16. To transition from the straight-drilling mode to the directional-drilling mode, rotation of drillstring 21 at the surface is reduced or ceased, and drill bit 90 is instead rotated by mud motor 35 in response to pumping drilling fluid from surface pump 23 to mud motor 35.

In an embodiment, initially well system 10 may continue to drill borehole 16 in the directional-drilling mode with bend adjustment assembly 300 disposed in the first position 303 providing the first deflection angle θ1 formed between the central axis 115 of driveshaft housing 110 and the central axis 95 of drill bit 90. Thus, a curved portion of borehole 16 may be formed initially with well system 10 operating in the directional-drilling mode and bend adjustment assembly 300 disposed in the first position 303, where the radius of curvature of the curved portion of borehole 16 being defined by first deflection angle θ1.

As drill bit 90 forms the curved portion of the borehole 16, it may be desirable to actuate bend adjustment assembly 300 from first position 303 to the second position 305 to adjust or control the trajectory of the borehole 16. For example, in this embodiment, it may be desired to drill a substantially straight, horizontal portion of borehole 16 following the drilling of the curved portion of borehole 16. In an embodiment, to actuate bend adjustment assembly 300 in-situ (assembly 300 being positioned in borehole 16) from the first position 303 to the second position 305, the flow or pressure of drilling fluid supplied by surface pump 34 may be increased from a first or drilling flowrate or pressure to a second or threshold flowrate or pressure that is greater than the drilling flowrate or pressure. For example, in an application where the drilling flowrate of drilling fluid supplied to mud motor 35 from surface pump 23 is approximately 500 gallons per minute (GPM), the threshold flowrate may be approximately 550-900 GPM or between approximately 10% and 80% greater than the drilling flowrate of well system 10; however, in other embodiments, the threshold flowrate for actuating bend adjustment assembly 300 from the first position 303 to the second position 305 may vary in the extent that the threshold flowrate exceeds the drilling flowrate, the threshold flowrate always being greater than the drilling flowrate so as to not hinder the operation of well system 10 prior to the actuation of lower adjustment mandrel 370 from the lower axial position to the upper axial position. For example, the threshold flowrate or pressure may be altered by increasing or decreasing the number of shear pins 379 and/or by altering the geometry (e.g., increasing or decreasing the cross-sectional area) and/or materials comprising shear pin 379. In this manner, the operator may control the flowrate of drilling fluid (or cease pumping drilling fluid altogether) without inadvertently triggering the actuation of bend adjustment assembly 300 so long as the operator does not achieve or exceed the threshold flowrate or pressure, providing additional flexibility to the operator in controlling the operation of mud motor 35

Figure 14:
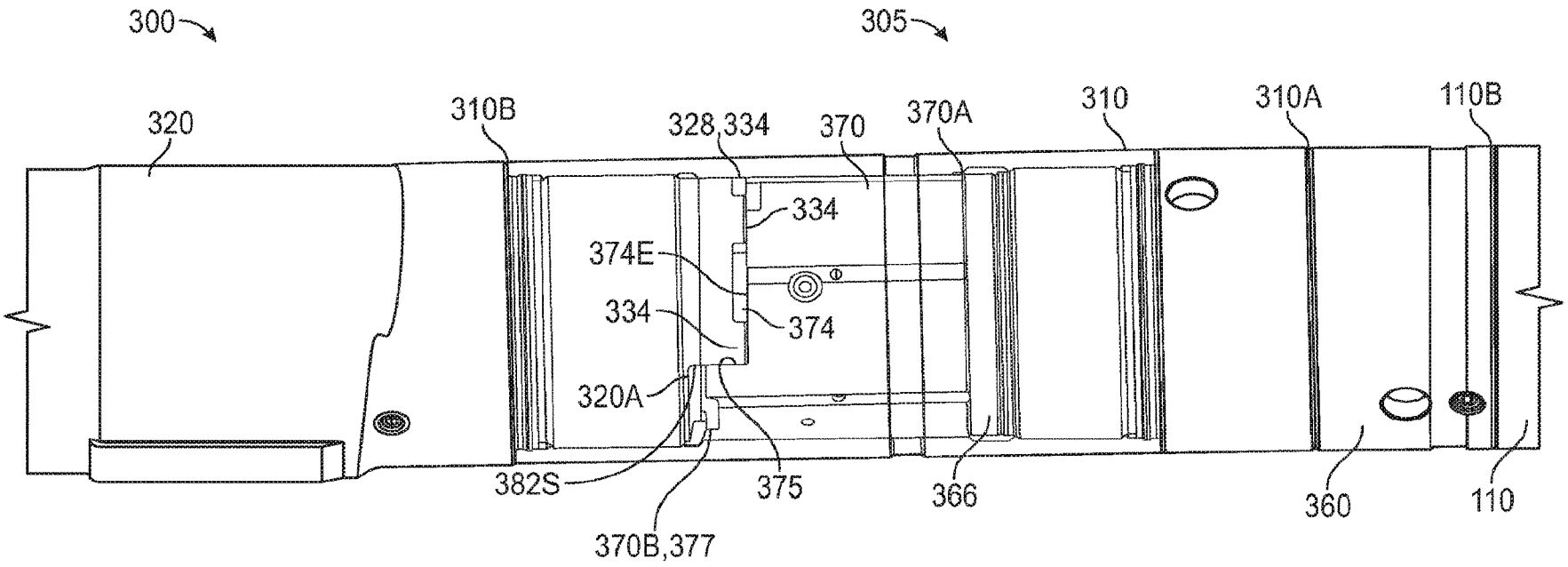
FIG. 14 is a zoomed-in side view of the bearing assembly of FIG. 4 in a second position.
Figure 15:
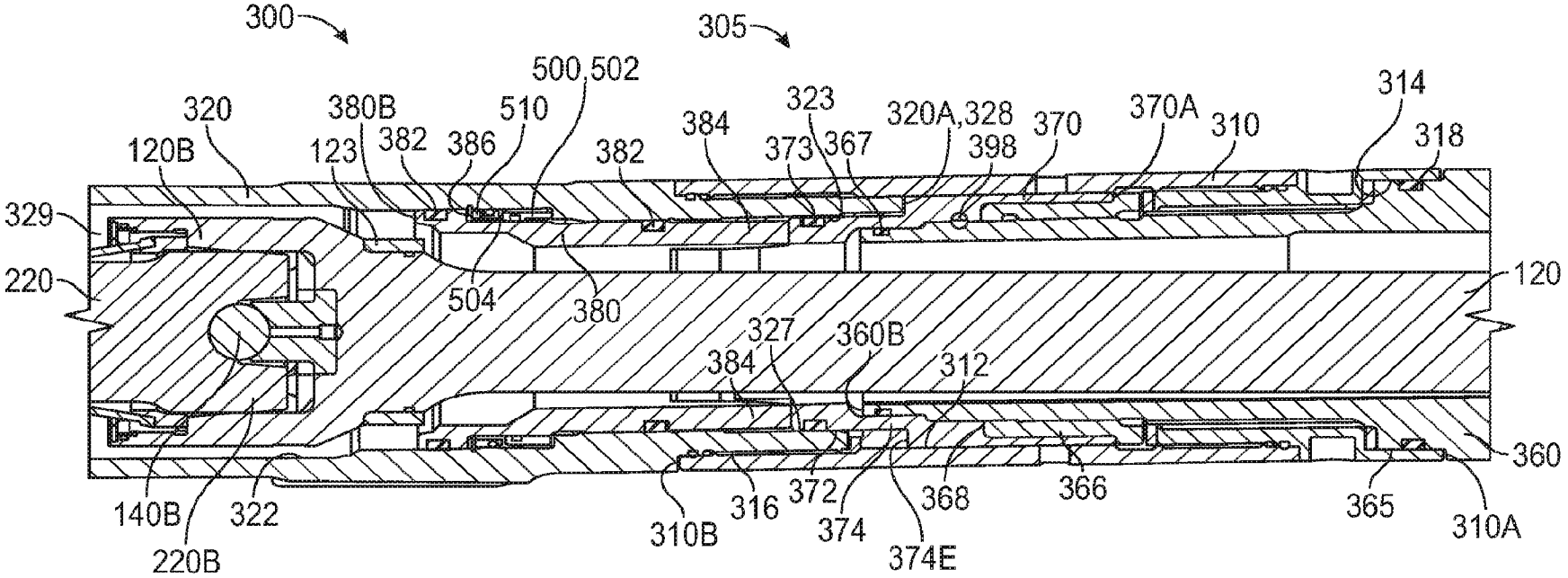
FIG. 15 is a zoomed-in, side cross-sectional view of the bearing assembly of FIG. 4 in the second position.

Once the threshold flowrate or pressure of drilling fluid from surface pump 23 is achieved, a net pressure force in the uphole direction is applied to lower adjustment mandrel 370 which is sufficient to shear or frangibly break shear pin 379 whereby the lower adjustment mandrel 370 is forced by the uphole directed net pressure force from the lower axial position (shown in FIG. 13) to the upper axial position (shown in FIGS. 14, 15). Due to the sealing engagement of seal 373, the upper end 370A of lower adjustment mandrel 370 is exposed to pressure applied by biasing member 354 as well as the lubricant pressure contained in locking chamber 395 (maintained at wellbore pressure via pressure transmitted to locking chamber 395 from compensating chamber 359 through compensating piston 356) while lower end 370B is exposed to the pressure of drilling fluid flowing through bend adjustment assembly 300. Thus, an increase in flowrate of the drilling fluid supplied by surface pump 23 increases the uphole directed pressure force applied to the lower end 370B of lower adjustment mandrel 370. With lower adjustment mandrel 370 in the upper axial position, castellations 377 of lower adjustment mandrel 370 are unlocked from castellations 334 of lower housing 320. Additionally, in this embodiment, keys 384 of locking piston 380 are not received in either of slots 376, 378 when lower adjustment mandrel 370 is initially displaced into the upper axial position, and thus, relative rotation between lower adjustment mandrel 370 and lower housing 320 is permitted following the displacement of lower adjustment mandrel 370 from the lower axial position to the upper axial position.

In this embodiment, bend adjustment assembly 300 comprises a locking pin 398 (shown in FIG. 15) configured to lock lower adjustment mandrel 370 in the upper axial position once lower adjustment mandrel 370 has actuated from the lower axial position to the upper axial position. Particularly, locking pin 398 is disposed in a first or unlocked position when lower adjustment mandrel 370 is in the lower axial position, and comprises a biasing member configured to force locking pin 398 in a second or locked position once lower adjustment mandrel 370 reaches the upper axial position to restrict relative axial movement between lower adjustment mandrel 370 and upper adjustment mandrel 360. In some embodiments, locking pin 398 is configured similarly as the pin assembly 690 described in U.S. patent application Ser. No. 16/398,158, which is incorporated herein by reference in its entirety for all purposes.

Further, in this embodiment, a flow restriction formed between the inner surface of locking piston 380 and flow restrictor 123 of driveshaft 120 when lower adjustment mandrel 370 is in the lower axial position may be reduced when lower adjustment mandrel 370 is displaced into the upper axial position. The flow restriction may be registered or indicated by a pressure decrease in the drilling fluid pumped into drillstring 21 by surface pump 23, where the pressure decrease results from a reduction in the backpressure provided by the flow restriction. Thus, bend adjustment assembly 300 is configured in this embodiment to provide a surface indication of the displacement of lower adjustment mandrel 370 into the upper axial position. In some embodiments, the displacement of lower adjustment mandrel 370 into the upper axial position may be registered at the surface via an increase in backpressure resulting from an increase in the flow restriction formed between locking piston 380 and the flow restrictor 123 of driveshaft 120.

In this embodiment, following the displacement of lower adjustment mandrel 370 into the upper axial position, bend adjustment assembly 300 may be actuated from the first position 303 to the second position 305 by ceasing the pumping of drilling fluid from surface pump 23 for a predetermined first period of time. Either concurrent with the first time period or following the start of the first time period, rotary system 24 is activated to rotate drillstring 21 at a first or actuation rotational speed for a predetermined second period of time. In some embodiments, both the first time period and the second time period each comprise approximately 15-120 seconds; however, in other embodiments, the first time period and the second time period may vary.

Additionally, in some embodiments, the actuation rotational speed comprises approximately 1-70 revolutions per minute (RPM) of drillstring 21; however, in other embodiments, the actuation rotational speed may vary. During the second time period, with drillstring 21 rotating at the actuation rotational speed, reactive torque is applied to bearing housing 210 via physical engagement between stabilizers 211 and the wall 19 of borehole 16, thereby rotating bearing housing 210 and offset housings 310, 320, relative to the adjustment mandrels 360, 370 in a first rotational direction. Rotation of lower housing 320 causes extension 328 to rotate through recess 374 of lower adjustment mandrel 370 until a shoulder 328S physically engages a corresponding shoulder 375 of recess 374, restricting further rotation of lower housing 320 in the first rotational direction. In some embodiments, this process may or may not be performed on bottom while drilling ahead.

Following the first and second time periods (the second time period ending either at the same time as the first time period or after the first time period has ended), with bend adjustment assembly 300 disposed in the second position 305 (shown in FIGS. 14, 15), drilling fluid is pumped through drillstring 21 from surface pump 23 at a first flowrate for a predetermined third period of time while drillstring 21 is rotated by rotary system 24 at the actuation rotational speed. In some embodiments, the third period of time comprises approximately 15-120 seconds and the first flowrate of drilling fluid from surface pump 23 comprises approximately 30%-80% of a maximum drilling fluid flowrate of well system 10; however, in other embodiments, the third period of time and the first flowrate may vary. The maximum drilling fluid flowrate of well system 10 is dependent on the application, including the size of drillstring 21 and BHA 30. For instance, the maximum drilling fluid flowrate of well system 10 may comprise the maximum drilling fluid flowrate that may be pumped through drillstring 21 and BHA 30 before components of drillstring 21 and/or BHA 30 are eroded or otherwise damaged by the mud flowing therethrough. In some embodiments, this process may or may not be performed on bottom while drilling ahead.

Following the third period of time, the flowrate of drilling fluid from surface pump 23 is increased from the first flowrate to a flowrate near or at the maximum drilling fluid flowrate of well system 10 to dispose locking piston 380 in the locked position. In this embodiment, with drilling fluid being pumped into drillstring 21 at or near the maximum drilling fluid flowrate and the drillstring 21 being rotated at the actuation rotational speed, locking piston 380 is disposed in the locked position with keys 384 received in long slots 378 (shown in FIG. 15) of lower adjustment mandrel 370. With locking piston 380 disposed in the locked position, drilling of borehole 16 via BHA 30 may be continued with surface pump 23 pumping drilling fluid into drillstring 21 at or near the maximum drilling fluid flowrate of well system 10. In this embodiment, the flow restriction formed between the inner surface of locking piston 380 and flow restrictor 123 of driveshaft 120 is reduced when locking piston 380 is in the locked position to provide a surface indication (e.g., via a reduced backpressure at the surface) of the actuation of locking piston 380 into the locked position. In other embodiments, the flow restriction may be increased when the locking piston 380 is in the locked position and reduced or abated when locking piston 380 is in the unlocked position. Once surface pump 23 is pumping drilling fluid at the drilling or maximum drilling fluid flowrate of well system 10, rotation of drillstring 21 via rotary system 24 may be ceased, continued at the actuation rotational speed, or increased to a maximum permissible rotational speed of well system 10. In this embodiment, by actuating bend adjustment assembly 300 from the first position 303 to the second position 305, the deflection angle θ provided by bend adjustment assembly 300 may be actuated from the first deflection angle θ1 (approximately 1.5 degrees in some embodiments) to the second deflection angle θ2 (approximately 0 degrees in some embodiments). In other words, bend adjustment assembly 300 may be actuated from a low bend setting to a zero bend or undeflected setting.

Figure 16:
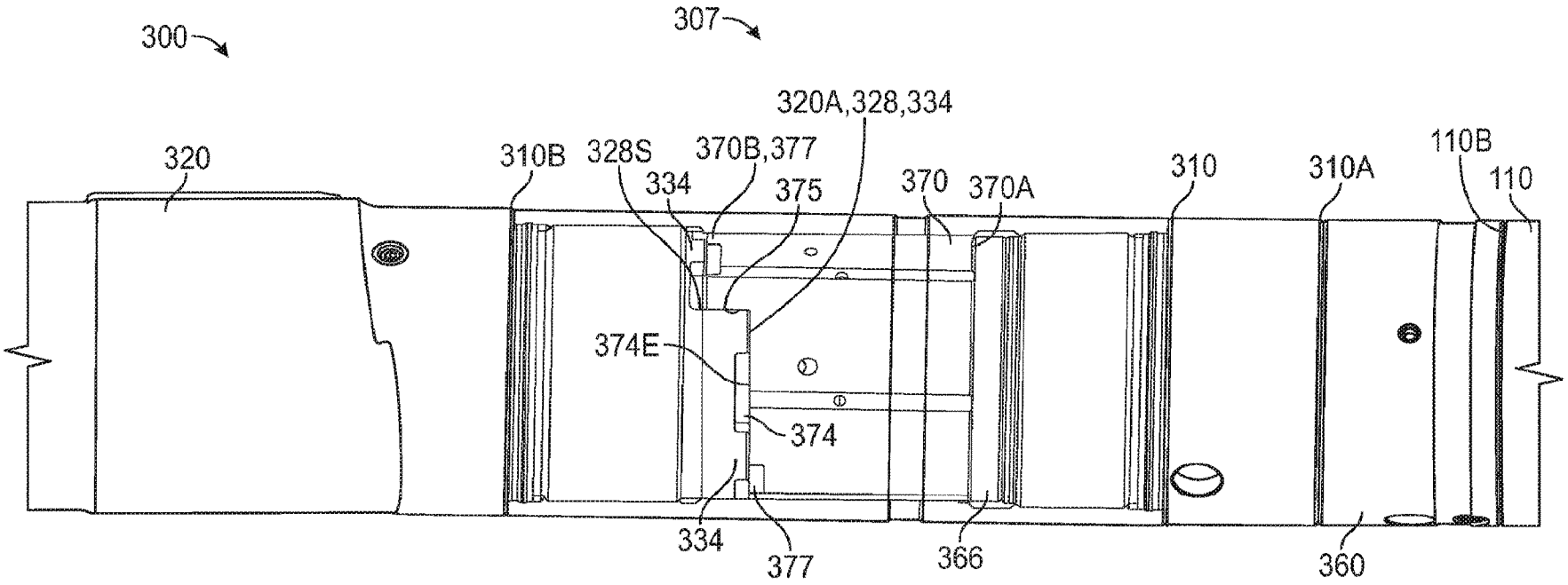
FIG. 16 is a zoomed-in side view of the bearing assembly of FIG. 4 in a third position.
Figure 17:
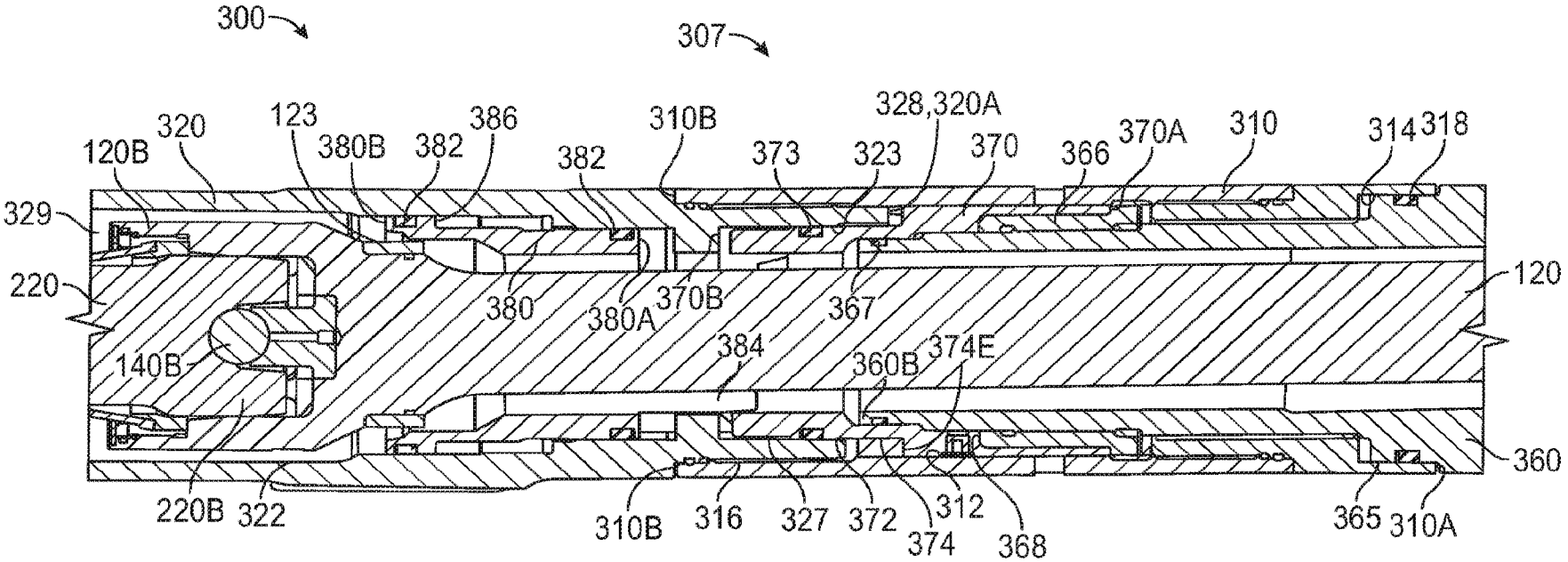
FIG. 17 is a zoomed-in, side cross-sectional view of the bearing assembly of FIG. 4 in the third position.

On occasion, it may be desirable to actuate bend adjustment assembly 300 from the second position 305 (shown in FIGS. 14, 15) to the third position 307 (shown in FIGS. 16, 17). For example, it may be desirable to alter the trajectory of borehole 16 by forming a second curved portion following the substantially straight, horizontal portion of borehole 16 drilled with bend adjustment assembly 300 in the second position 305. In this embodiment, actuator assembly 400 is configured to actuate bend adjustment assembly from the second position 305 to the third position 307. Particularly, actuator assembly 400 is configured to selectively or controllably transfer torque from bearing mandrel 220 (supplied to mandrel 220 by rotor 50) to actuator housing 340 in response to changes in the flowrate of drilling fluid supplied to mud motor 35.

Particularly, in an embodiment, to actuate bend adjustment assembly from the second position 305 to the third position 307, surface pump 23 may continue to pump drilling fluid into drillstring 21 while rotary system 24 remains inactive. In other embodiments, surface pump 23 may cease pumping drilling fluid into drillstring 21 while rotary system 24 remains inactive. In some embodiments, surface pump 23 pumps drilling fluid through drillstring 21 at a second flowrate that is reduced by a predetermined percentage from the maximum drilling fluid flowrate of well system 10. In some embodiments, the second flowrate of drilling fluid from surface pump 23 comprises approximately 1%-40% of the maximum drilling fluid flowrate of well system 10; however, in other embodiments, the second flowrate may vary. For instance, in some embodiments, the second flowrate may comprise zero or substantially zero fluid flow. In this embodiment, surface pump 23 continues to pump drilling fluid into drillstring 21 at the second flowrate for a predetermined fourth time period while rotary system 24 remains inactive. In some embodiments, the fourth time period comprises approximately 15-120 seconds; however, in other embodiments, the fourth time period may vary.

During the fourth time period with drilling fluid flowing through BHA 30 from drillstring 21 at the second flowrate, rotational torque is transmitted to bearing mandrel 220 via rotor 50 of power section 40 and driveshaft 120. Additionally, with a reduction in a pressure force applied to the lower end 402B of piston 402 (relative to upper end 402A of piston 402 which receives wellbore pressure) biasing member 413 applies a biasing force against shoulder 404 of actuator piston 402 sufficient to urge actuator piston 402 into contact with teeth ring 420, with teeth 410 of piston 402 in meshing engagement with the teeth 424 of teeth ring 420. In this arrangement, torque applied to bearing mandrel 220 is transmitted to actuator housing 340 via the meshing engagement between teeth 424 of teeth ring 420 (rotationally fixed to bearing mandrel 220) and teeth 410 of actuator piston 402 (rotationally fixed to actuator housing 340). Rotational torque applied to actuator housing 340 via actuator assembly 400 is transmitted to offset housings 310, 320, which rotate (along with bearing housing 210) in a second rotational direction (opposite the first rotational direction described above) relative adjustment mandrels 360, 370. Particularly, extension 328 of lower housing 320 rotates through arcuate recess 374 of lower adjustment mandrel 370 until a shoulder 328S engages a corresponding shoulder 375 of recess 374, restricting further relative rotation between offset housings 310, 320, and adjustment mandrels 360, 370. Following the rotation of lower housing 320, bend adjustment assembly 300 is disposed in the third position 307 (shown in FIGS. 16, 17) and thereby forms third deflection angle θ3. Additionally, although during the actuation of bend adjustment assembly 300 drilling fluid flows therethrough at the second flowrate, the second flowrate is not sufficient to overcome the biasing force provided by biasing member 354 against locking piston 380 to thereby actuate locking piston 380 back into the locked position.

Directly following the fourth time period, with bend adjustment assembly 300 now disposed in the third position 307, the flowrate of drilling fluid from surface pump 23 is increased from the second flowrate to a third flowrate that is greater than the second flowrate. In some embodiments, the third flowrate of drilling fluid from surface pump 23 comprises approximately 50%-100% of the maximum drilling fluid flowrate of well system 10; however, in other embodiments, the third flowrate may vary. Following the fourth time period with drilling fluid flowing through BHA 30 from drillstring 21 at the third flowrate, the fluid pressure applied to the lower end 380B of locking piston 380 is sufficiently increased to overcome the biasing force applied against the upper end 380A of piston 380 via biasing member 354, actuating or displacing locking piston 380 from the unlocked position to the locked position with keys 384 received in short slots 376 (shown in FIG. 17), thereby rotationally locking offset housings 310, 320, with adjustment mandrels 360, and 370. Thus, locking piston 380 may thereby lock bend adjustment assembly 300 into the third position 307.

Additionally, with drilling fluid flowing through BHA 30 from drillstring 21 at the third flowrate, fluid pressure applied against the lower end 402B of actuator piston 402 from the drilling fluid (via the pressure applied to piston 402 from compensating piston 226) is increased, overcoming the biasing force applied against shoulder 404 by biasing member 413 and thereby disengaging actuator piston 402 from teeth ring 420. With actuator piston 402 disengaged from teeth ring 420, torque is no longer transmitted from bearing mandrel 220 to actuator housing 340 through piston 402.

Further, in this embodiment, a flow restriction formed between the inner surface of locking piston 380 and flow restrictor 123 of driveshaft 120 when locking piston 380 is in the unlocked position may be reduced when locking piston 380 is actuated into the locked position to thereby provide a surface indication of the position of locking piston 380. In some embodiments, the flowrate of drilling fluid from surface pump 23 may be maintained at or above the third flowrate to ensure that locking piston 380 remains in the locked position. In some embodiments, as borehole 16 is drilled with bend adjustment assembly 300 in the third position 307, additional pipe joints may need to be coupled to the upper end of drillstring 21, necessitating the stoppage of the pumping of drilling fluid to power section 40 from surface pump 23. In some embodiments, following such a stoppage, the steps described above for actuating bend adjustment assembly 300 into the third position 307 may be repeated to ensure that assembly 300 remains in the third position 307. In this embodiment, by actuating bend adjustment assembly 300 from the second position 305 to the third position 307, the deflection angle θ provided by bend adjustment assembly 300 may be actuated from the second deflection angle θ2 (approximately 0 degrees in some embodiments) to the third deflection angle θ3 (approximately 2.1 degrees in some embodiments). In other words, bend adjustment assembly 300 may be actuated from a zero bend or undeflected setting to a high bend setting.

Bend adjustment assembly 300 may be actuated between the second position 305 and third position 307 in-situ within borehole 16 an unlimited number of times; however, bend adjustment assembly 300 may not reenter the first position 303 without retrieving mud motor 35 from borehole 16. Additionally, immediately following the displacement of lower adjustment mandrel 370 from the lower axial position to the upper axial position, bend adjustment assembly 300 may be actuated directly from the first position 303 to the third position 307 by following the procedure described above for actuating bend adjustment assembly from the second position 305 to the third position 307.

In an alternative embodiment, the procedures for shifting bend adjustment assembly 300 between the second position 305 and the third position 307 may be reversed by reconfiguring lower adjustment mandrel 370 of bend adjustment assembly 300 such that, for example, first position 303 provides a first deflection angle θ1 of approximately 1.5 degrees, second position 305 provides a second deflection angle θ2 of approximately 2.12 degrees, and third position 307 provides a third deflection angle θ3 of approximately 0 degrees. Particularly, in this alternative embodiment, the features of lower adjustment mandrel 370 are inverted or mirrored about the circumference of lower adjustment mandrel 370.

By inverting the features of lower adjustment mandrel 370 (of lower adjustment mandrel 370, the alternative embodiment of bend adjustment assembly 300 may be shifted from the second position 305 to the third position 307 by ceasing the pumping of drilling fluid from surface pump 23 for the first period of time to shift locking piston 380 into the unlocked position. Then, either concurrent with first time period or following the start of the first time period, activating rotary system 24 to rotate drillstring 21 at the actuation rotational speed for the second period of time to apply reactive torque to bearing housing 210 and rotate offset housing 320 relative to adjustment mandrel 370 in the first rotational direction, thereby shifting the alternative embodiment of bend adjustment assembly 300 into the third position 307. Surface pump 23 may then be operated at the first flowrate for the third period of time or immediately operated at the maximum drilling fluid flowrate of well system 10 to shift locking piston 380 into the locked position, thereby locking the alternative embodiment of bend adjustment assembly 300 into the third position 307.

Additionally, the alternative embodiment of bend adjustment assembly 300 may be shifted from the third position 307 to the second position 305 by ceasing rotation of drillstring 21 from rotary system 24 and ceasing the pumping of drilling fluid from surface pump 23 to thereby shift locking piston 380 into the unlocked position. With locking piston 380 disposed in the unlocked position, surface pump 23 resumes pumping drilling fluid into drillstring 21 at the second flowrate while rotary system 24 remains inactive, thereby rotating lower adjustment mandrel 370 in the second rotational direction to shift the alternative embodiment of bend adjustment assembly 300 into the second position 305. With the alternative embodiment of bend adjustment assembly 300 now disposed in second position 305, the flowrate of drilling fluid from surface pump 23 is increased from the second flowrate to the third flowrate to shift locking piston 380 into the locked position, thereby locking the alternative embodiment of bend adjustment assembly 300 in the second position 305.

Figure 18:
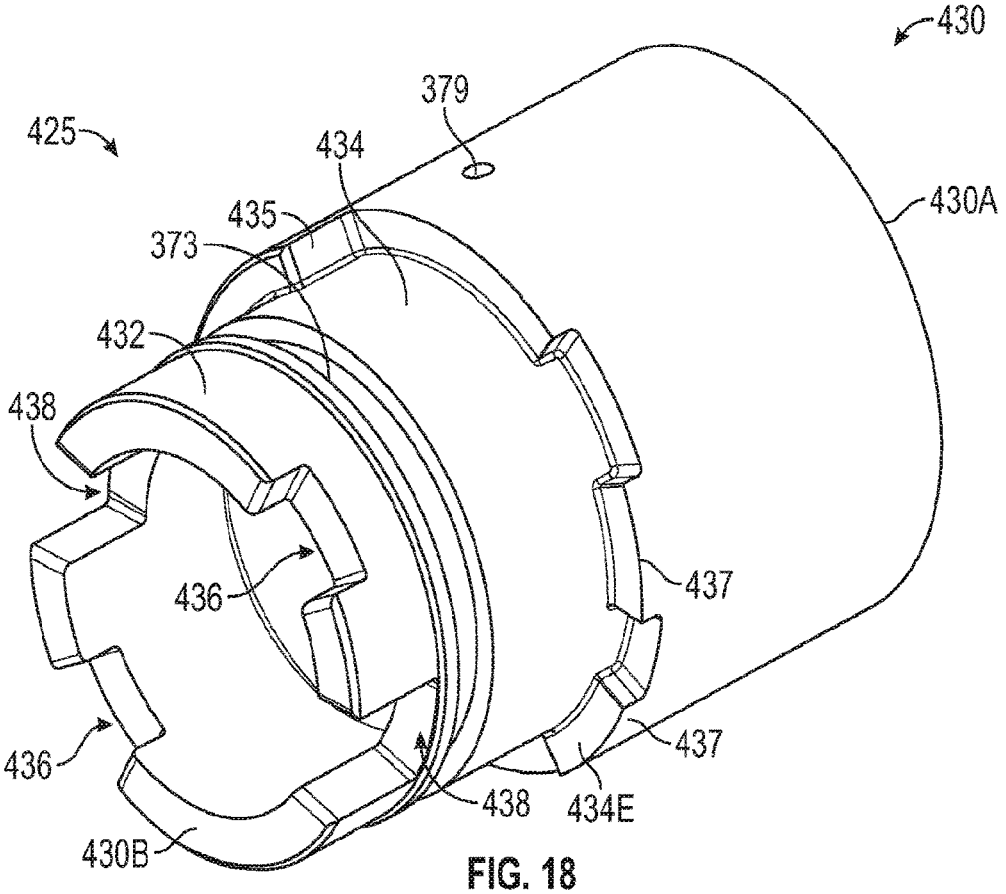
FIG. 18 is a perspective view of an adjustment mandrel of another adjustable bend assembly according to some embodiments.

In another alternative embodiment, bend adjustment assembly 300 may only comprise two positions and may or may not include actuator assembly 400. Particularly, the deflection angle provided by the bend adjustment assembly when an adjustment mandrel of the bend adjustment assembly is in a first axial position may equal one of a pair of deflection angles providable by the bend adjustment assembly when the adjustment mandrel of the assembly is in a second axial position. For example, referring to FIG. 18, another embodiment of a lower adjustment mandrel 430 of a bend adjustment assembly 425 is shown. While only the lower adjustment mandrel 430 of bend adjustment assembly 425 is shown in FIG. 18, bend adjustment assembly 425 may be (besides lower adjustment mandrel 430) similar in configuration to the bend adjustment assembly 300 shown in FIGS. 2-17. In other words, in addition to lower adjustment mandrel 430, bend adjustment assembly 515 may include, for example, housings 310, 320, upper adjustment mandrel 360, piston mandrel 350, compensating piston 356, locking piston 380, and actuator assembly 400.

Lower adjustment mandrel 430 may include some features in common with the lower adjustment mandrel 370 shown particularly in FIG. 11, and shared features are labeled similarly. In this embodiment, lower adjustment mandrel 430 generally includes a first or upper end 430A, a second or lower end 430B opposite upper end 430A, and a central bore or passage extending therebetween that is defined by a generally cylindrical inner surface. Additionally, lower adjustment mandrel 430 includes a generally cylindrical outer surface comprising an offset engagement surface 432, annular seal 373, and an arcuately extending recess 434. The arcuate recess 434 of lower adjustment mandrel 430 is defined by an inner terminal end or arcuate shoulder 434E and a pair of circumferentially spaced axially extending shoulders 435. Lower adjustment mandrel 430 also includes a pair of circumferentially spaced first or short slots 436 and a pair of circumferentially spaced second or long slots 438, where both short slots 436 and long slots 438 extend axially into lower adjustment mandrel 430 from lower end 430B. Lower adjustment mandrel 430 further includes a plurality of circumferentially spaced protrusions or castellations 437 configured to matingly or interlockingly engage the castellations 334 formed at the upper end 320A of lower housing 320.

The first position or first fixed bend configuration of bend adjustment assembly 425 may comprise a first or initial position or configuration of assembly 425. The castellations 334 of lower housing 320 may interlock with castellations 437 of lower adjustment mandrel 430 when bend adjustment assembly 425 is in the first position, preventing actuation of the bend adjustment assembly 425 from the first position until a threshold flowrate or pressure is achieved or exceeded through bend adjustment assembly 425. Upon achieving or exceeding the threshold flowrate or pressure, the lower adjustment mandrel 430 may actuate from a first or lower axial position (corresponding to the first position of bend adjustment assembly 425) to a second or upper axial position. With lower adjustment mandrel 430 in the upper axial position, bend adjustment assembly 425 may be actuated or toggled between a second position and a third position in a manner similar to the actuation of bend adjustment assembly 300 between the second position 305 and third position 307. However, unlike bend adjustment assembly 300, one of the second position and the third position of bend adjustment assembly 425 may provide a deflection angle that is equal to a first deflection angle provided by assembly 425 when in the first position. For example, the first position of bend adjustment assembly 425 may correspond to either an undeflected setting or a low bend setting (e.g., a deflection angle of approximately 1.5 degrees in some examples), the second position of assembly 425 may equal or correspond to the setting of the first position, and the third position of assembly 425 corresponds to a setting have a greater bend than the first and second positions; alternatively, the first position may correspond to a high bend setting while the second position corresponds to an undeflected or a low bend setting and the third position equals the setting of the first position. Thus, bend adjustment assembly 425 may provide only two positions while providing a fixed bend configuration (corresponding to the lower axial position of the lower adjustment mandrel 430) and a variable bend configuration (corresponding to the upper axial position of the lower adjustment mandrel 430).

Figure 19:
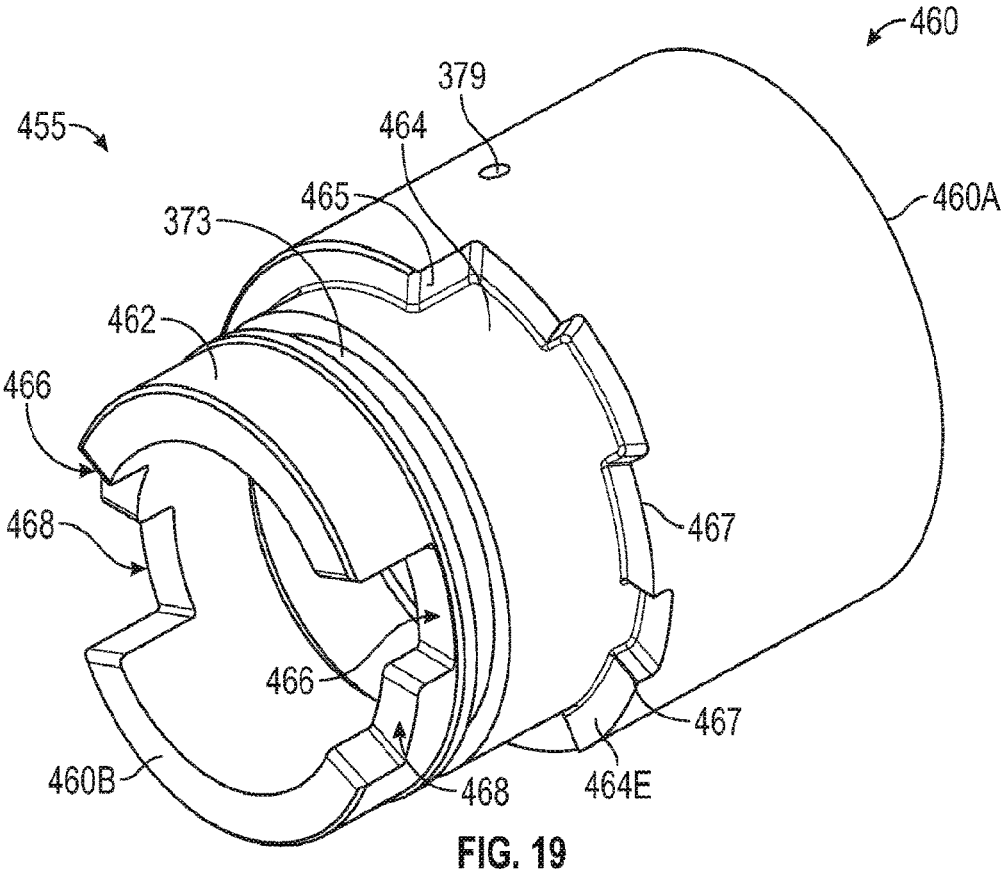
FIG. 19 is a perspective view of an adjustment mandrel of another adjustable bend assembly according to some embodiments.

Referring to FIG. 19, another embodiment of a lower adjustment mandrel 460 of a bend adjustment assembly 455 is shown. While only the lower adjustment mandrel 460 of bend adjustment assembly 455 is shown in FIG. 19, bend adjustment assembly 455 may be (besides lower adjustment mandrel 460) be similar in configuration to the bend adjustment assembly 300 shown in FIGS. 2-17. In other words, in addition to lower adjustment mandrel 460, bend adjustment assembly 455 may include, for example, housings 310, 320, upper adjustment mandrel 360, piston mandrel 350, compensating piston 356, locking piston 380, and actuator assembly 400.

Rather than being configured to permit the actuation of bend adjustment assembly 455 between three separate and distinct positions, the lower adjustment mandrel 460 of bend adjustment assembly 455 may be configured to provide assembly 455 with a first position providing a first deflection angle and a second position providing a second deflection that is different from the first deflection angle. In embodiments, the first deflection angle of bend adjustment assembly 455 may be greater than zero but less than the second deflection angle. In other words, the first deflection angle may correspond to a low bend setting (providing a deflection angle of approximately 1.5 degrees in one example) of bend adjustment assembly 455 while the second deflection angle may correspond to a high bend (providing a deflection angle of approximately 2.1 degrees in one example) setting of bend adjustment assembly 455.

The first position of bend adjustment assembly 455 may correspond to a first or lower axial position of lower adjustment mandrel 460 (relative to lower housing 320) while the second position of bend adjustment assembly 455 may correspond to a second or upper axial position of lower adjustment mandrel 460 which is axially spaced form the lower axial position. The lower adjustment mandrel 460 may be actuated from the lower axial position to the upper axial position in a manner similar to the actuation of lower adjustment mandrel 370 from the lower axial position of mandrel 370 to the upper axial position of mandrel 370 (e.g., achieving or exceeding a threshold flowrate or pressure through bend adjustment assembly 455). However, unlike bend adjustment assembly 300 which may be actuated into a variable bend configuration whereby assembly 300 may be toggled between second and third positions 305, 307, bend adjustment assembly 455 may be locked into the second position upon being actuated thereto. In other words, bend adjustment assembly 455 may comprise a "single shift" bend adjustment assembly actuatable from a first fixed bend configuration to a second fixed bend configuration (providing a different deflection angle from the first fixed bend configuration) by displacing lower adjustment mandrel 460 from the lower axial position to the upper axial position. In this manner, the operator may be free to vary the fluid flowrate through bend adjustment assembly 455 as desired (as long as the flowrate or pressure is less than the threshold flowrate or pressure) when assembly 455 is in the first fixed bend configuration without inadvertently actuating bend adjustment assembly 455; once actuated into the second fixed bend configuration, the operator may be free to vary the fluid flowrate through bend adjustment assembly 455 as desired without inadvertently returning to the first fixed bend configuration given that lower adjustment mandrel 460 is locked into the upper axial position.

Lower adjustment mandrel 460 may include some features in common with the lower adjustment mandrel 370 shown particularly in FIG. 11, and shared features are labeled similarly. In this embodiment, lower adjustment mandrel 460 generally includes a first or upper end 460A, a second or lower end 460B opposite upper end 460A, and a central bore or passage extending therebetween that is defined by a generally cylindrical inner surface. Lower adjustment mandrel may be rotationally locked to the outer sleeve 366 while permitting relative axial movement therebetween. Additionally, lower adjustment mandrel 460 includes a generally cylindrical outer surface comprising an offset engagement surface 462, annular seal 373, and an arcuately extending recess 464. Offset engagement surface 464 has a central or longitudinal axis that is offset or disposed at a non-zero angle relative to a central or longitudinal axis of the upper end 460A of lower adjustment mandrel 460 and the lower end 320B of lower housing 320, where offset engagement surface 462 is disposed directly adjacent or overlaps the offset engagement surface 323 of lower housing 320.

The arcuate recess 464 of lower adjustment mandrel 460 is defined by an inner terminal end or arcuate shoulder 464E and a pair of circumferentially spaced axially extending shoulders 465. Lower adjustment mandrel 460 also includes a pair of circumferentially spaced first or short slots 466 and a pair of circumferentially spaced second or long slots 468, where both short slots 466 and long slots 468 extend axially into lower adjustment mandrel 460 from lower end 460B. In this embodiment, each short slot 466 is circumferentially spaced approximately 180° apart. Similarly, in this embodiment, each long slot 468 is circumferentially spaced approximately 180° apart; however, in other embodiments, the circumferential spacing of short slots 466 and long slots 468 may vary. Additionally, in this embodiment, each short slot 466 is disposed directly adjacent one of the pair of long slots 468 such that there is no arcuate gap formed between adjacent short and long slots 466, 468.

In this embodiment, the lower end 460B of lower adjustment mandrel 460 further includes a plurality of circumferentially spaced protrusions or castellations 467 configured to matingly or interlockingly engage the castellations 334 formed at the upper end 320A of lower housing 320. Castellations 467 are spaced substantially about the circumference of lower adjustment mandrel, and may be formed on the portion of the circumference of lower adjustment mandrel 460 comprising recess 464 as well as the portion of the circumference of lower adjustment mandrel 460 which is arcuately spaced from recess 464. Castellations 467 may be circumferentially spaced uniformly about a circumference of lower adjustment mandrel 460; alternatively, castellations 467 may only be positioned along a portion of the circumference of lower adjustment mandrel 460.

The first position or first fixed bend configuration of bend adjustment assembly 455 may comprise a first or initial position or configuration of assembly 455. The castellations 334 of lower housing 320 may interlock with castellations 467 of lower adjustment mandrel 460 when bend adjustment assembly 455 is in the first position, preventing actuation of the bend adjustment assembly 455 from the first position until a threshold flowrate or pressure is achieved or exceeded through bend adjustment assembly 455. Additionally, the keys 384 of locking piston 380 may be received in the pair of short slots 466 of lower adjustment mandrel 460 when bend adjustment assembly 460 is in the first position.

Bend adjustment assembly 455 may be actuated from the first position to the second position in a manner similar to the actuation of bend adjustment assembly 300 shown in FIGS. 2-17 from the first position 303 to the second position 305. Particularly, surface pump 23 pumps drilling fluid through drillstring 21 at a flowrate that is reduced by a predetermined percentage (e.g., 1% to 40%, etc.) from the maximum drilling fluid flowrate of well system 10. As drilling fluid is pumped at the reduced flowrate, the teeth ring 420 may engage actuator piston 402 to transfer torque between bearing mandrel 220 and actuator housing 340 whereby extension 328 of lower housing 320 rotates through arcuate recess 464 of lower adjustment mandrel 460 until a shoulder 328S engages a corresponding shoulder 465 of recess 464, restricting further relative rotation between offset housings 310, 320, and adjustment mandrels 360, 460 and thereby positioning bend adjustment assembly 455 in the second position.

Additionally, as the bend adjustment assembly 455 enters the second position, keys 384 of locking piston 380 rotate through short slots 466 and enter into circumferential alignment with long slots 468 of lower adjustment mandrel 460. The pressure differential acting on locking piston 380 from the drilling fluid flowing through bend adjustment assembly 455 is sufficient to displace locking piston 380 upwards whereby keys 384 enter into long slots 468. With keys 384 interlockingly received in long slots 468, relative rotational movement between locking piston 380 (along with lower housing 320) and lower adjustment mandrel 460 is restricted.

In an embodiment, the amount of biasing force applied by biasing member 354 against the upper end 380A of locking piston 380 may be reduced such that frictional engagement between locking piston 380 and lower housing 320 is sufficient to maintain the axial position of locking piston 380 within housing 320 even when the surface pump 23 ceases pumping and pressure within bend adjustment assembly 455 is permitted to substantially equalize with wellbore pressure. In other words, upon the entering of keys 384 into long slots 468 of lower adjustment mandrel 460, locking piston 380 may become axially locked to lower adjustment mandrel 460 such that the operator of bend adjustment assembly 455 may be free to vary the flowrate of drilling fluid therethrough as desired (even ceasing the flow of fluid therethrough entirely) without inadvertently unlocking bend adjustment assembly 455 from the second position. The second position of bend adjustment assembly 455 may therefore comprise a second fixed bend configuration. A pressure signal provided by flow restrictor 123 may provide a surface indication of the actuation of bend adjustment assembly 455 into the second position.

Figure 20:
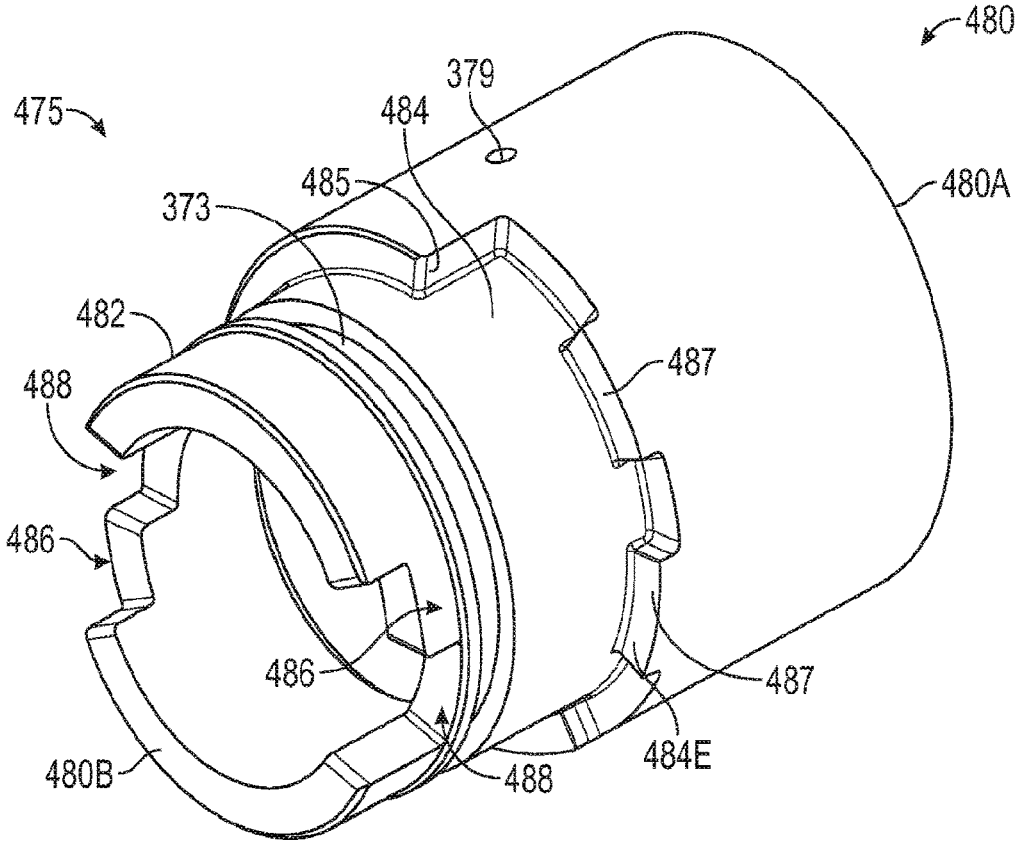
FIG. 20 is a perspective view of an adjustment mandrel of another adjustable bend assembly according to some embodiments.

Referring to FIG. 20, another embodiment of a lower adjustment mandrel 480 of a bend adjustment assembly 475 is shown. While only the lower adjustment mandrel 480 of bend adjustment assembly 475 is shown in FIG. 20, bend adjustment assembly 475 may be (besides lower adjustment mandrel 480) similar in configuration to the bend adjustment assembly 300 shown in FIGS. 2-17 and the bend adjustment assembly 455 shown in FIG. 19. In other words, in addition to lower adjustment mandrel 480, bend adjustment assembly 475 may include, for example, housings 310, 320, upper adjustment mandrel 360, piston mandrel 350, compensating piston 356, and locking piston 380. However, bend adjustment assembly 475 may not include actuator assembly 400 in some embodiments. Like the bend adjustment assembly 455 shown in FIG. 19, bend adjustment assembly 475 may comprise a single shift assembly configured to actuate from a first fixed bend configuration to a second fixed bend configuration in response to the bend adjustment assembly 475 being provided with drilling fluid at or exceeding a threshold flowrate or pressure. In embodiments, the first deflection angle of bend adjustment assembly 475 (corresponding to a first position or first fixed bend configuration of assembly 475) may be greater than a second deflection angle (corresponding to a second position or second fixed bend configuration of assembly 475). The first deflection angle may correspond to a high bend setting (providing a deflection angle of approximately 2.1 degrees in one example) of bend adjustment assembly 475 while the second deflection angle may correspond to a low bend setting (providing a deflection angle of approximately 1.5 degrees in one example) of bend adjustment assembly 475.

Lower adjustment mandrel 480 may include some features in common with the lower adjustment mandrel 460 shown particularly in FIG. 19, and shared features are labeled similarly. In this embodiment, lower adjustment mandrel 480 generally includes a first or upper end 480A, a second or lower end 480B opposite upper end 480A, and a central bore or passage extending therebetween that is defined by a generally cylindrical inner surface. Additionally, lower adjustment mandrel 480 includes a generally cylindrical outer surface comprising an offset engagement surface 482, annular seal 373, and an arcuately extending recess 484. The arcuate recess 484 of lower adjustment mandrel 480 is defined by an inner terminal end or arcuate shoulder 484E and a pair of circumferentially spaced axially extending shoulders 485. Lower adjustment mandrel 480 also includes a pair of circumferentially spaced first or short slots 486 and a pair of circumferentially spaced second or long slots 488, where both short slots 486 and long slots 488 extend axially into lower adjustment mandrel 480 from lower end 480B. In this embodiment, each short slot 486 is circumferentially spaced approximately 180° apart. Similarly, in this embodiment, each long slot 488 is circumferentially spaced approximately 180° apart; however, in other embodiments, the circumferential spacing of short slots 486 and long slots 488 may vary. Additionally, in this embodiment, each short slot 486 is disposed directly adjacent one of the pair of long slots 488 such that there is no arcuate gap formed between adjacent short and long slots 486, 488. The circumferential arrangement of slots 486, 488 may be similar to the arrangement of slots 466, 468 of the lower adjustment mandrel 460 shown in FIG. 19; however, in this embodiment, the arrangement of slots 486, 488 is reversed or flipped from slots 466, 468. Particularly, each short slot 486 may be directly adjacent each long slot 488 in a counter-clockwise direction while each short slot 466 may be directly adjacent each long slot 468 in a clockwise direction. Lower adjustment mandrel 480 further includes a plurality of circumferentially spaced protrusions or castellations 487 configured to matingly or interlockingly engage the castellations 334 formed at the upper end 320A of lower housing 320.

The first position or first fixed bend configuration of bend adjustment assembly 475 may comprise a first or initial position or configuration of assembly 475. The castellations 334 of lower housing 320 may interlock with castellations 487 of lower adjustment mandrel 480 when bend adjustment assembly 475 is in the first position, preventing actuation of the bend adjustment assembly 475 from the first position until a threshold flowrate or pressure is achieved or exceeded through bend adjustment assembly 475. Additionally, the keys 384 of locking piston 380 may be received in the pair of short slots 486 of lower adjustment mandrel 480 when bend adjustment assembly 480 is in the first position.

Bend adjustment assembly 475 may be actuated from the first position (a high bend setting providing a deflection angle of 2.1 degrees in some embodiments) to the second position (a low bend setting position providing a deflection angle of 1.5 degrees in some embodiments) by rotating drillstring 21 from the surface. For example, following the shearing of shear members 379 and actuation of lower adjustment mandrel 480 from a first or lower position to a second or upper position by applying a flowrate to bend adjustment assembly 475 which meets or exceeds the threshold flowrate or pressure, the pumping of drilling fluid from surface pump 23 may be ceased while rotary system 24 is activated to rotate drillstring 21 (e.g., at approximately 1-70 RPM for example). The rotation of drillstring 21 causes extension 328 of lower housing 320 to rotate through recess 484 (in response to the application of reactive torque applied to bearing housing 210 from the wall 19 of borehole 16) until a shoulder 328S engages a corresponding shoulder 485 of recess 484, thereby positioning bend adjustment assembly 475 in the second position.

Additionally, as the bend adjustment assembly 475 enters the second position, keys 384 of locking piston 380 rotate through short slots 486 and enter into circumferential alignment with long slots 488 of lower adjustment mandrel 480. The pressure differential acting on locking piston 380 from the drilling fluid flowing through bend adjustment assembly 475 is sufficient to displace locking piston 380 upwards whereby keys 384 enter into long slots 488. With keys 384 interlockingly received in long slots 488, relative rotational movement between locking piston 380 (along with lower housing 320) and lower adjustment mandrel 480 is restricted. As with the bend adjustment assembly 455 shown in FIG. 19, the amount of biasing force applied by biasing member 354 against the upper end 380A of locking piston 380 may be reduced such that frictional engagement between locking piston 380 and lower housing 320 is sufficient to maintain the axial position of locking piston 380 within housing 320 even when the surface pump 23 ceases pumping and pressure within bend adjustment assembly 475 is permitted to substantially equalize with wellbore pressure. In this configuration, the second position of bend adjustment assembly 475 may therefore comprise a second fixed bend configuration. A pressure signal provided by flow restrictor 123 may provide a surface indication of the actuation of bend adjustment assembly 475 into the second position.

Figure 21:
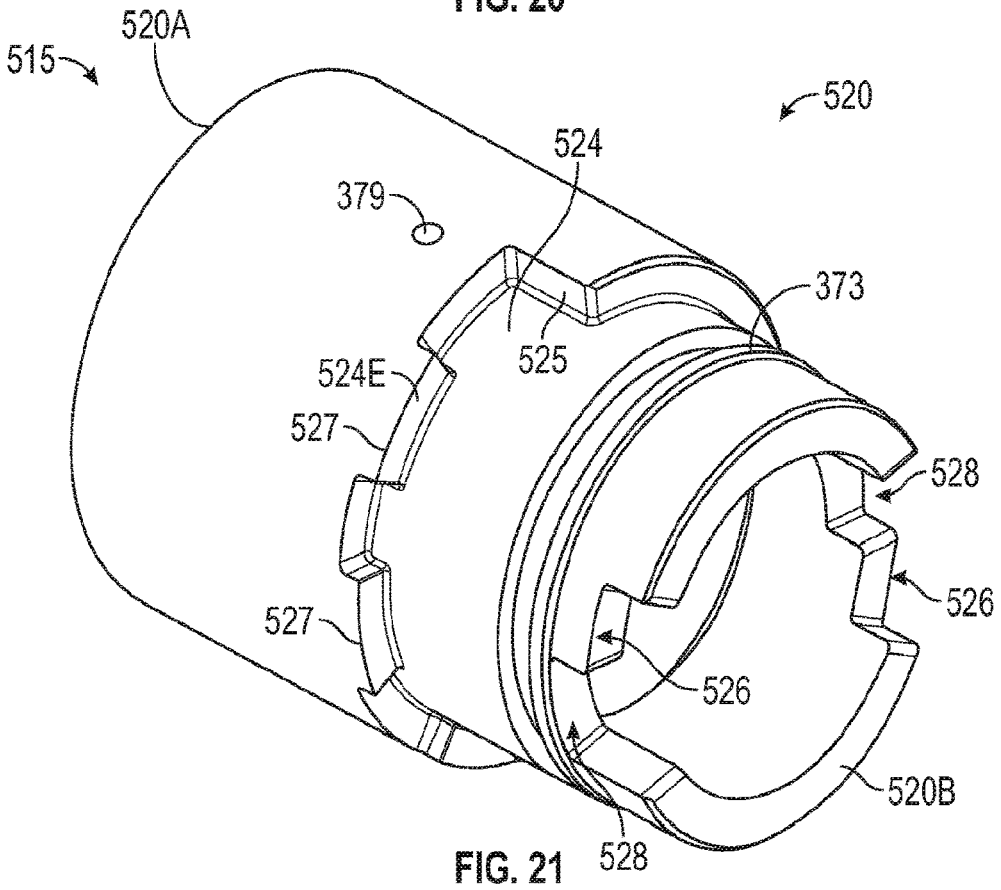
FIG. 21 is a perspective view of an adjustment mandrel of another adjustable bend assembly according to some embodiments.

Referring to FIG. 21, another embodiment of a lower adjustment mandrel 520 of a bend adjustment assembly 515 is shown. While only the lower adjustment mandrel 520 of bend adjustment assembly 515 is shown in FIG. 21, bend adjustment assembly 515 may be (besides lower adjustment mandrel 520) similar in configuration to the bend adjustment assembly 300 shown in FIGS. 2-17. In other words, in addition to lower adjustment mandrel 520, bend adjustment assembly 515 may include, for example, housings 310, 320, upper adjustment mandrel 360, piston mandrel 350, compensating piston 356, locking piston 380, and actuator assembly 400.

Like the bend adjustment assemblies 455, 475 shown in FIGS. 19, 20, bend adjustment assembly 515 may comprise a single shift assembly configured to actuate from a first fixed bend configuration to a second fixed bend configuration in response to the bend adjustment assembly 515 being provided with drilling fluid at or exceeding a threshold flowrate or pressure. In embodiments, the first deflection angle of bend adjustment assembly 515 (corresponding to a first position or first fixed bend configuration of assembly 515) may be greater than a second deflection angle (corresponding to a second position or second fixed bend configuration of assembly 515). The first deflection angle may correspond to a high bend setting (providing a deflection angle of approximately 2.1 degrees in one example) of bend adjustment assembly 515 while the second deflection angle may correspond to a low bend setting (providing a deflection angle of approximately 1.5 degrees in one example) of bend adjustment assembly 515.

Lower adjustment mandrel 520 may include some features in common with the lower adjustment mandrel 480 shown particularly in FIG. 20, and shared features are labeled similarly. In this embodiment, lower adjustment mandrel 520 generally includes a first or upper end 520A, a second or lower end 520B opposite upper end 520A, and a central bore or passage extending therebetween that is defined by a generally cylindrical inner surface. Additionally, lower adjustment mandrel 520 includes a generally cylindrical outer surface comprising an offset engagement surface 522, annular seal 373, and an arcuately extending recess 524. The arcuate recess 524 of lower adjustment mandrel 520 is defined by an inner terminal end or arcuate shoulder 524E and a pair of circumferentially spaced axially extending shoulders 525. Lower adjustment mandrel 520 also includes a pair of circumferentially spaced first or short slots 526 and a pair of circumferentially spaced second or long slots 528, where both short slots 526 and long slots 528 extend axially into lower adjustment mandrel 520 from lower end 520B. Additionally, in this embodiment, each short slot 526 is disposed directly adjacent one of the pair of long slots 528 such that there is no arcuate gap formed between adjacent short and long slots 526, 528. Lower adjustment mandrel 520 further includes a plurality of circumferentially spaced protrusions or castellations 527 configured to matingly or interlockingly engage the castellations 334 formed at the upper end 320A of lower housing 320.

The first position or first fixed bend configuration of bend adjustment assembly 515 may comprise a first or initial position or configuration of assembly 515. The castellations 334 of lower housing 320 may interlock with castellations 527 of lower adjustment mandrel 520 when bend adjustment assembly 515 is in the first position, preventing actuation of the bend adjustment assembly 515 from the first position until a threshold flowrate or pressure is achieved or exceeded through bend adjustment assembly 515. Additionally, the keys 384 of locking piston 380 may be received in the pair of short slots 526 of lower adjustment mandrel 520 when bend adjustment assembly 520 is in the first position.

Bend adjustment assembly 515 may be actuated from the first position (a high bend setting position in some embodiments) to the second position (a low bend setting position in some embodiments) via the operation of actuator assembly 400 in a manner similar to that described in further detail above. The difference in the method of actuation (e.g., rotation of drillstring 21 versus the actuation of actuator assembly 400) between bend adjustment assembly 475 and bend adjustment assembly 515 may be a function of the respective angular positions of recesses 484, 524, short slots 486, 526, and long slots 488, 528, respectively.

Additionally, as the bend adjustment assembly 515 enters the second position, keys 384 of locking piston 380 rotate through short slots 526 and enter into circumferential alignment with long slots 528 of lower adjustment mandrel 520. With keys 384 interlockingly received in long slots 528, relative rotational movement between locking piston 380 (along with lower housing 320) and lower adjustment mandrel 520 is restricted. As with the bend adjustment assemblies 455, 475 shown in FIGS. 19, 20, the amount of biasing force applied by biasing member 354 against the upper end 380A of locking piston 380 may be reduced such that frictional engagement between locking piston 380 and lower housing 320 is sufficient to maintain the axial position of locking piston 380 within housing 320 even when the surface pump 23 ceases pumping and pressure within bend adjustment assembly 515 is permitted to substantially equalize with wellbore pressure. In this configuration, the second position of bend adjustment assembly 515 may therefore comprise a second fixed bend configuration. A pressure signal provided by flow restrictor 123 may provide a surface indication of the actuation of bend adjustment assembly 515 into the second position.

Figure 22:
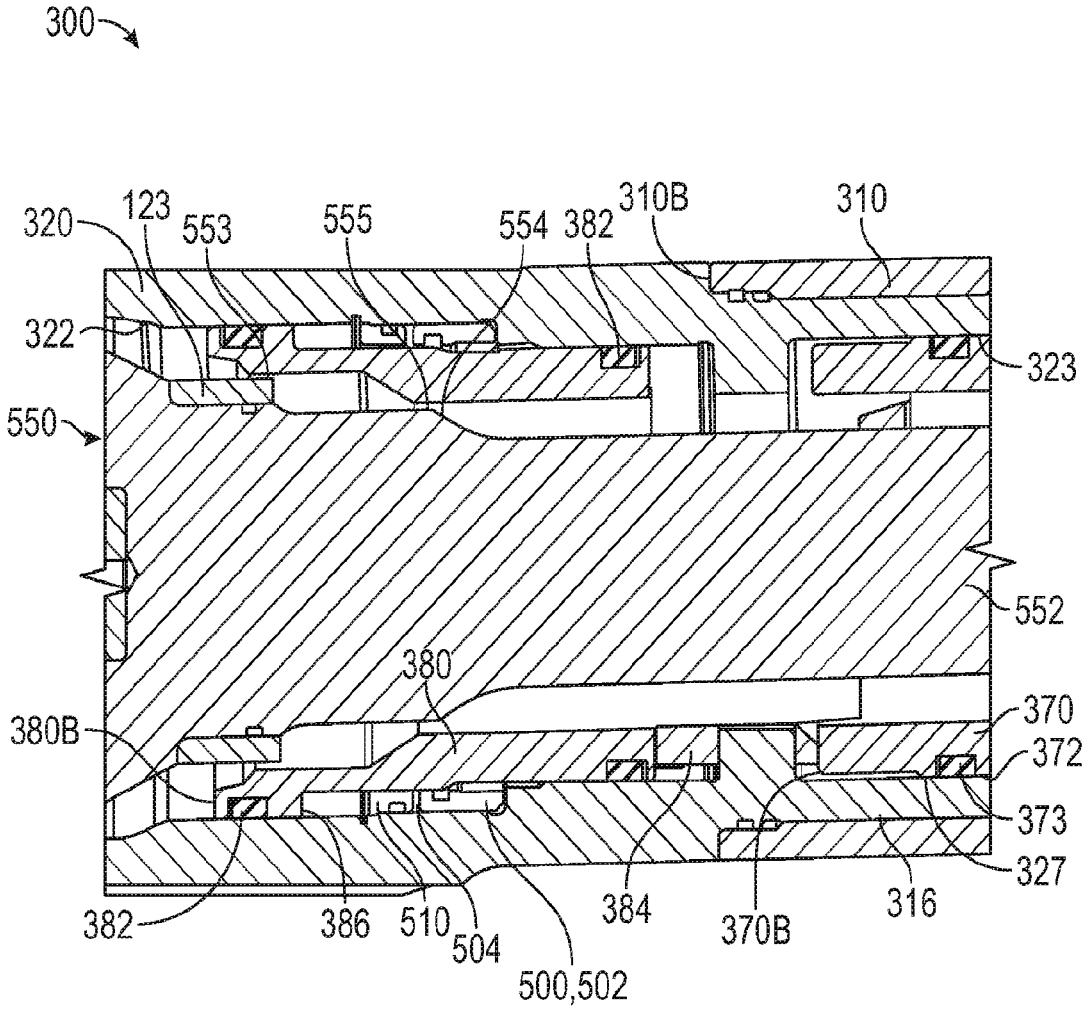
FIG. 22 is a zoomed-in, side cross-sectional view of another embodiment of a driveshaft assembly mud motor of FIG. 1.

Referring to FIG. 22, another embodiment of a driveshaft assembly 550 of the mud motor 35 of FIG. 1 is shown in FIG. 22. Driveshaft assembly 550 includes features in common with the driveshaft assembly 100 described above, and shared features are labeled similarly. Particularly, driveshaft assembly 100 is similar to driveshaft assembly 100 described above except that driveshaft assembly 550 includes a driveshaft 552 that includes an annular shoulder 554 which is axially spaced from flow restrictor 123, thereby creating two axially spaced "choke points" or variable flow restrictions 553 (formed between the inner surface of locking piston 380 and flow restrictor 123) and 555 (formed between the inner surface of locking piston 380 and shoulder 554 of driveshaft 552) for restricting the flow of drilling fluid through driveshaft assembly 550. Flow restrictor 123 and shoulder 554 may form a stepped flow restrictor. By including two separate choke points 553, 555 in series the pressure signal may be amplified at the surface by creating an overall larger flow restriction. Moreover, by utilizing two axially spaced choke points 553, 555 via flow restrictor 123 and shoulder 554 of driveshaft 552, a relatively large pressure drop and resulting pressure signal may be provided without needing to rely on a single choke point having a relatively small clearance that may clog with debris contained in the drilling fluid. In some embodiments, shoulder 554 and/or flow restrictor 123 may be provided with slots to enhance the ability of shoulder 554 and/or flow restrictor 123 to pass debris therethrough.

Figure 23:
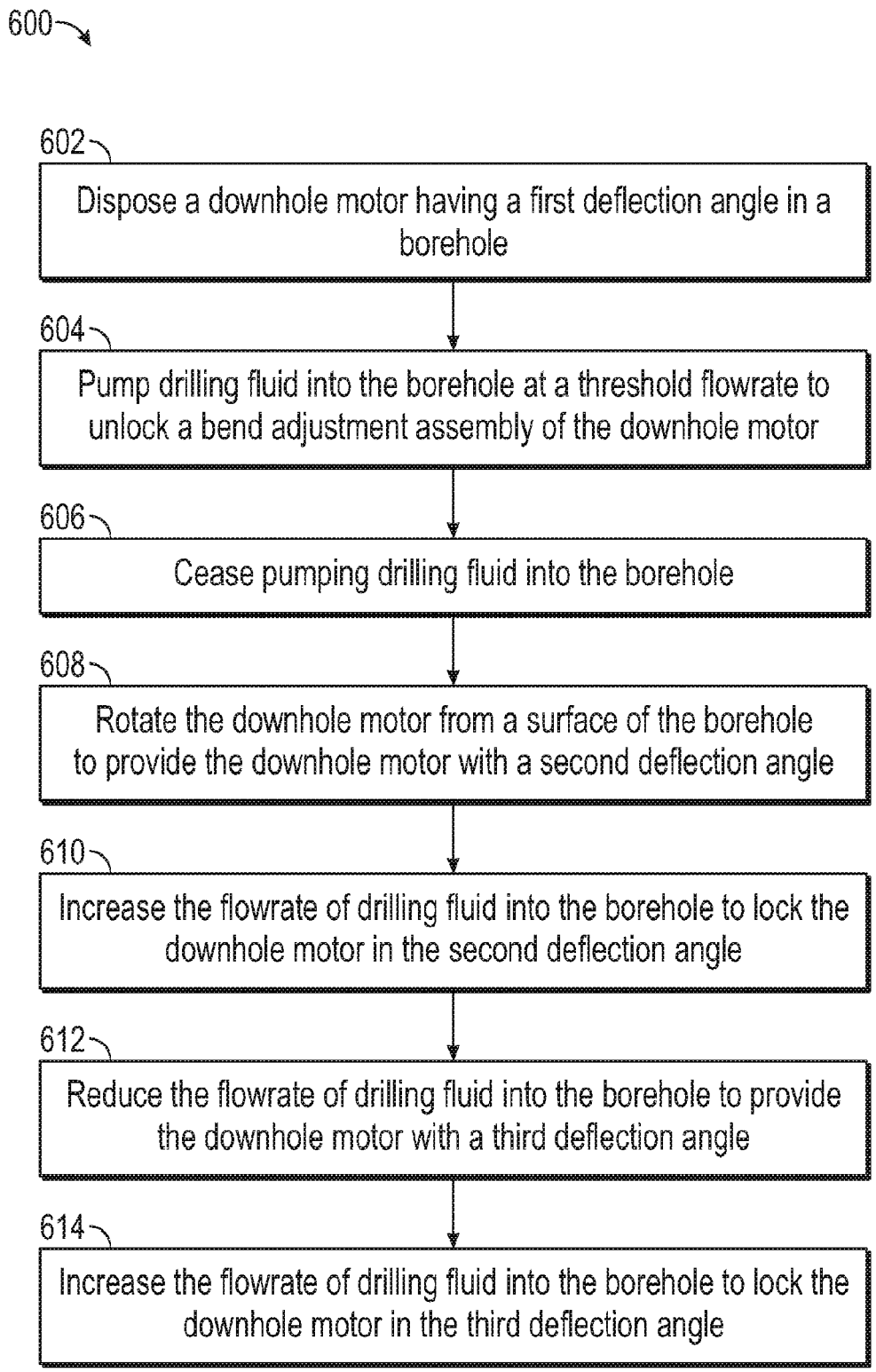
FIG. 23 is a block diagram of a method of adjusting a deflection angle of a downhole mud motor disposed in a borehole according to some embodiments.

Referring to FIG. 23, an embodiment of a method 600 for adjusting a deflection angle of a downhole mud motor disposed in a borehole is shown. At block 602 of method 600, a downhole mud motor having a first deflection angle is disposed in a borehole. In some embodiments, block 602 comprises providing downhole mud motor 35 (shown in FIG. 1) in borehole 16, mud motor 35 comprising a bend adjustment assembly 300 that provides a first deflection angle $\theta_1$ along motor 35.

At block 604 of method 600, drilling fluid is pumped into the borehole at a threshold flowrate or pressure to unlock a bend adjustment assembly of the mud motor. In some embodiments, block 604 comprises increasing the flow of drilling fluid supplied by surface pump 34 of well system 10 from a first or drilling flowrate to a second or threshold flowrate or pressure that is greater than the drilling flowrate or pressure whereby a net pressure force in the uphole direction is applied to lower adjustment mandrel 370 of bend adjustment assembly 300 which is sufficient to shear or frangibly break shear pin 379 and forcibly displace lower adjustment mandrel 370 from the lower axial position (shown in FIG. 13) to the upper axial position (shown in FIGS. 14, 15). In some embodiments, the threshold flowrate or pressure is between 10% and 80% greater than the drilling flowrate or pressure of well system 10.

At block 606 of method 600, the pumping of drilling fluid into the borehole is ceased. In some embodiments, block 606 comprises ceasing the pumping of surface pump 34 of well system 10 for a first period of time (e.g., 15-120 seconds. At block 608 of method 600, the downhole motor is rotated from the surface of the borehole to provide the downhole motor with a second deflection angle. In some embodiments, block 608 comprises activating rotary system 24 of well system 10 to rotate drillstring 21 at a first or actuation rotational speed (e.g., 1-70 RPM) for a predetermined second period of time (e.g., 15-120 seconds) whereby bearing housing 210 and offset housings 310, 320 of bend adjustment assembly 300, rotate relative to adjustment mandrels 360, 370 of bend adjustment assembly 300 in a first rotational direction. Rotation of lower housing 320 causes shoulder 328 to rotate through recess 374 of lower adjustment mandrel 370 until a shoulder 328S physically engages a corresponding shoulder 375 of recess 374, restricting further rotation of lower housing 320 in the first rotational direction.

At block 610, the flowrate of drilling fluid into the borehole is increased to lock the downhole motor in the second deflection angle. In some embodiments, block 610 comprises increasing the flowrate of drilling fluid from surface pump 23 of well system 10 from the first flowrate to a flowrate near or at the maximum drilling fluid flowrate of well system 10 to dispose locking piston 380 of bend adjustment assembly 300 in the locked position.

At block 612 of method 600, the flowrate of drilling fluid into the borehole is reduced to provide the downhole motor with a third deflection angle. In some embodiments, block 612 comprises reducing the flowrate provided by surface pump 23 of well system 10 from the drilling flowrate to a second flowrate that is reduced by a predetermined percentage (e.g., the second flowrate may be 1%-40% of the maximum drilling flowrate) from the maximum drilling fluid flowrate of well system 10. In some embodiments, block 612 further comprises applying a biasing force via biasing member 413 of actuator assembly 400 against shoulder 404 of actuator piston 402 to urge actuator piston 402 into contact with teeth ring 420, with teeth 410 of piston 402 in meshing engagement with the teeth 424 of teeth ring 420 whereby torque is applied to bearing mandrel 220 and is transmitted to actuator housing 340 via the meshing engagement between teeth 424 of teeth ring 420 and teeth 410 of actuator piston 402. Rotational torque applied to actuator housing 340 via actuator assembly 400 is thereby transmitted to offset housings 310, 320, which rotate in a second rotational direction to dispose bend adjustment assembly 300 in the third position 307 providing third deflection angle $\theta_3$.

At block 614 of method 600, the flowrate of drilling fluid into the borehole is increased to lock the downhole motor in the third deflection angle. In some embodiments, block 614 comprises increasing the flowrate of drilling fluid from surface pump 23 of well system 10 to a flowrate near or at the maximum drilling fluid flowrate of well system 10 to dispose locking piston 380 of bend adjustment assembly 300 in the locked position. In other embodiments, method 600 may only include blocks 602-610 and may thus exclude blocks 612, 614. In still other embodiments, blocks 612, 614 may directly follow blocks 602, 604 and method 600 may exclude blocks 606-610. In still other embodiments, blocks 606-610 may follow the performance of blocks 612, 614.

In some embodiments, method 600 may not include each block described above. For example, in an embodiment, method 600 may only include blocks 602-610, and thus may not include blocks 612, and 614. This embodiment may correspond to downhole motors including only a first deflection angle and a second deflection angle. In other embodiments, method 600 may not include blocks 608, 610, which instead may be replaced by blocks 612, 614 which may follow block 606.

Figure 24:
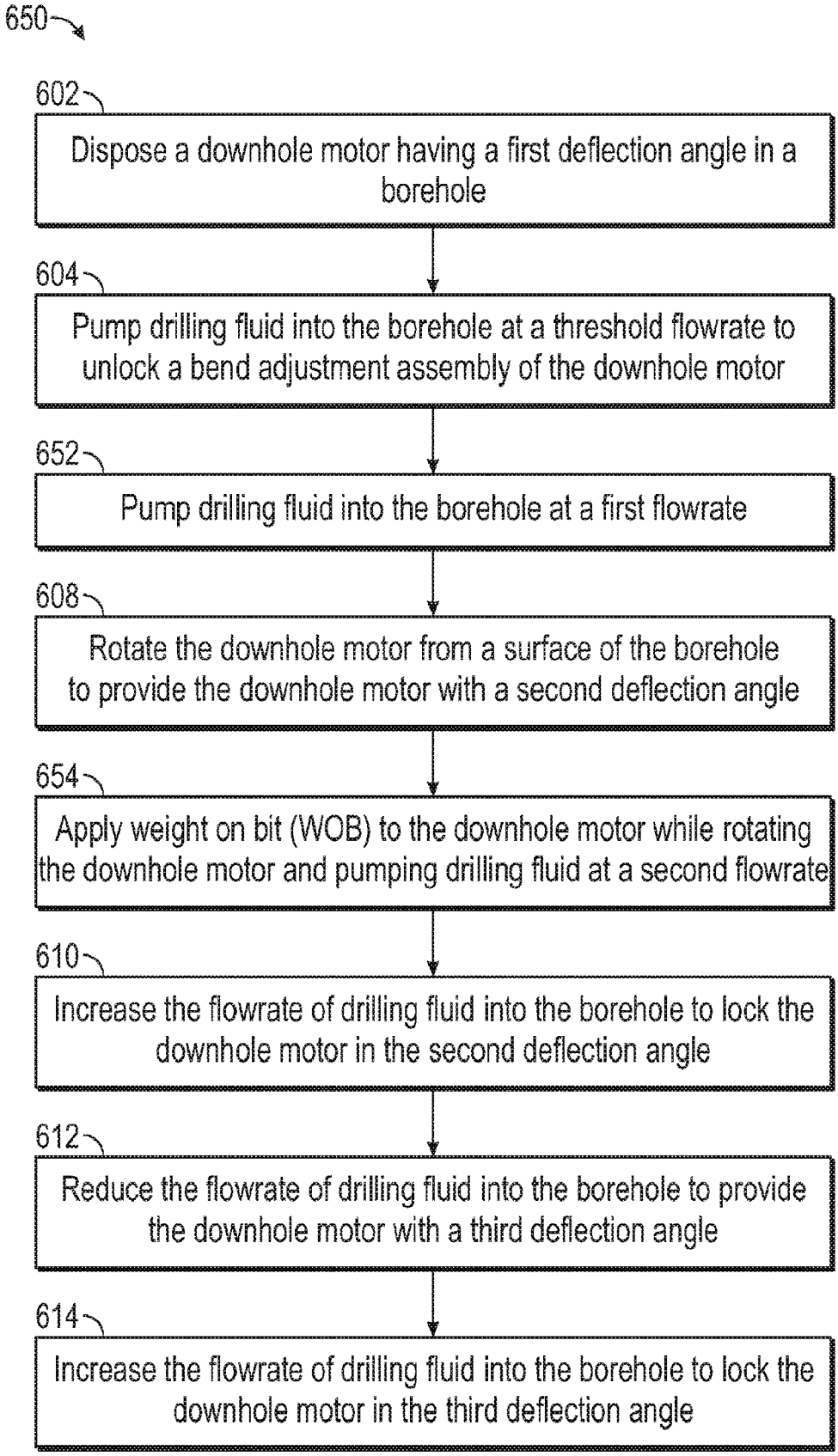
FIG. 24 is a block diagram of a method of adjusting a deflection angle of a downhole mud motor disposed in a borehole according to some embodiments.

Referring to FIG. 24, an embodiment of a method 650 for adjusting a deflection angle of a downhole mud motor disposed in a borehole is shown. Method 650 includes features and steps in common with method 600 shown in FIG. 23, and shared features are labeled similarly. Particularly, method 650 includes block 652 between blocks 604, 608, where block 652 comprises pumping drilling fluid into the borehole at a first flowrate. In some embodiments, block 652 comprises reducing the flowrate of drilling fluid below 10% of the drilling flowrate (the first flowrate being below 10% of the drilling flowrate) for a time period comprising approximately 15-120 seconds. In some embodiments, block 652 comprises pumping drilling fluid into drillstring 21 of well system 10 using surface pump 23, drillstring 21 extending from a drilling rig 20 disposed at the surface, and through borehole 16 to BHA 30 disposed in borehole 16 that comprises downhole mud motor 35. In certain embodiments of block 652, fluid flow through the downhole mud motor may be ceased for 15-120 seconds.

Method 650 also includes a block 654 between blocks 608, 610, where block 650 comprises applying weight on bit (WOB) to the downhole motor while rotating the downhole motor and pumping drilling fluid at a second flowrate. In some embodiments, block 654 comprises WOB is applied to the downhole mud motor by having the drill bit drill ahead a fixed distance (e.g., several feet). The application of WOB to the downhole mud motor may assist in torqueing the lower end of the downhole mud motor to aid in shifting the downhole mud motor to the position providing the second deflection angle. In certain embodiments of block 654, drilling fluid is pumped into drillstring 21 from surface pump 23 at 30%-75% of either the desired drilling flowrate or the maximum drilling fluid flowrate of drillstring 21 and/or BHA 30 while at least a portion of downhole mud motor 35 is rotated from the surface of borehole 16 for the second time period. In such an embodiment, the pumping of drilling fluid at the 30-75% rate from surface pump 23 causes torque applied to bearing mandrel 220 to be substantially reduced or ceased and not transmitted to actuator housing 340 of bend adjustment assembly 300 via meshing engagement between teeth 424 of teeth ring 420 and teeth 410 of actuator piston 402. Additionally, in some embodiments, block 610 of method 650 comprises pumping drilling fluid into the borehole at a third flowrate that is different from the first and second flowrates to lock the downhole mud motor (disposed in the borehole) in the second deflection angle while WOB is applied to the rotating downhole mud motor.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A downhole mud motor, comprising:

a driveshaft housing;

a driveshaft rotatably disposed in the driveshaft housing;

a bearing mandrel coupled to the driveshaft; and a bend adjustment assembly comprising a first position that provides a first deflection angle between a longitudinal axis of the driveshaft housing and a longitudinal axis of the bearing mandrel;

wherein the bend adjustment assembly includes a second position that provides a second deflection angle between the longitudinal axis of the driveshaft housing and the longitudinal axis of the bearing mandrel that is different from the first deflection angle;

wherein the bend adjustment assembly comprises an adjustment mandrel having a first axial position corresponding to the first position of the bend adjustment assembly and a second axial position axially spaced from the first axial position and which corresponds to the second position of the bend adjustment assembly;

wherein the bend adjustment assembly is prevented from actuating from the first position to the second position when the adjustment mandrel is in the first axial position, and wherein the bend adjustment assembly is actuatable, with the downhole mud motor positioned in a borehole, between the first position and the second position when the adjustment mandrel is in the second axial position that is axially spaced from the first axial position.

2. The downhole mud motor of claim 1, wherein:

interlocking engagement between the adjustment mandrel and an offset housing prevent the bend adjustment assembly from actuating from the first position to the second position when the adjustment mandrel is in the first axial position; and the adjustment mandrel is configured to shift from the first axial position to the second axial position in response to supplying the downhole mud motor with drilling fluid at a threshold pressure or a threshold flowrate.

3. The downhole mud motor of claim 1, wherein: the bend adjustment assembly comprises an offset housing comprising a first plurality of circumferentially spaced protrusions, and wherein the adjustment mandrel comprises a second plurality of circumferentially spaced protrusions; and the first plurality of protrusions are interlocked with the second plurality of protrusions when the bend adjustment assembly is in the first position, and wherein the first plurality of protrusions are disengaged from the second plurality of protrusions when the bend adjustment assembly is in the second position.

4. The downhole mud motor of claim 1, wherein the bend adjustment assembly includes a third position that provides a third deflection angle between the longitudinal axis of the driveshaft housing and the longitudinal axis of the bearing mandrel that is different from the first deflection angle and the second deflection angle, and wherein the second axial position of the adjustment mandrel corresponds to the third position of the bend adjustment assembly.

5. The downhole mud motor of claim 4, further comprising an actuator assembly configured to shift the bend adjustment assembly between the second position and the third position in response to a change in at least one of flowrate of a drilling fluid supplied to the downhole mud motor, pressure of the drilling fluid supplied to the downhole mud motor, and relative rotation between the driveshaft housing and the bearing mandrel.

6. The downhole mud motor of claim 1, further comprising:

a shear pin configured to retain the adjustment mandrel in the first axial position, wherein the shear pin is configured to shear and release the adjustment mandrel from the first axial position in response to supplying the downhole mud motor with drilling fluid at a threshold pressure or a threshold flowrate; and a locking pin configured to retain the adjustment mandrel in the second axial position.

7. The downhole mud motor of claim 1, further comprising a locking piston configured to lock the bend adjustment assembly in the second position.

8. The downhole mud motor of claim 1, wherein the adjustment mandrel comprises an arcuate recess extending between a pair of shoulders;

the bend adjustment assembly comprises an offset housing comprising an arcuate extension extending between a pair of shoulders; and one of the pair of shoulders of the offset housing engages one of the shoulders of the adjustment mandrel when the bend adjustment assembly is in the first position.

9. The downhole mud motor of claim 8, wherein the bend adjustment assembly is actuatable between the first position and the second position with the adjustment mandrel in the second axial position in response to a change in at least one of flowrate of the drilling fluid supplied to the downhole mud motor, pressure of the drilling fluid supplied to the downhole mud motor, and relative rotation between the driveshaft housing and the bearing mandrel.

10. The downhole mud motor of claim 1, wherein the adjustment mandrel comprises an arcuate recess extending between a pair of shoulders;

the bend adjustment assembly comprises an offset housing comprising an arcuate extension extending between a pair of shoulders; and each of the pair of shoulders of the offset housing is spaced from each of the shoulders of the adjustment mandrel when the bend adjustment assembly is in the first position.

11. The downhole mud motor of claim 1, further comprising a stepped flow restrictor positioned on an outer surface of the driveshaft, wherein the flow restrictor comprises a pair of axially spaced choke points configured to restrict a flow of the drilling fluid between the driveshaft and a locking piston disposed about the driveshaft and to provide a surface indication of the deflection angle of the bend adjustment assembly.

12. A downhole mud motor, comprising:

a driveshaft housing;

a driveshaft rotatably disposed in the driveshaft housing;

a bearing mandrel coupled to the driveshaft; and a bend adjustment assembly comprising a first position that provides a first deflection angle between a longitudinal axis of the driveshaft housing and a longitudinal axis of the bearing mandrel;

wherein the bend adjustment assembly includes a second position that provides a second deflection angle between the longitudinal axis of the driveshaft housing and the longitudinal axis of the bearing mandrel that is different from the first deflection angle;

wherein the bend adjustment assembly comprises:

an adjustment mandrel having a first axial position corresponding only to the first position of the bend adjustment assembly, and a second axial position axially spaced from the first position which corresponds only to the second position of the bend adjustment assembly and wherein the bend adjustment assembly is actuatable, with the downhole mud motor positioned in a borehole, between the first position and the second position when the adjustment mandrel is in the second axial position; and an offset housing comprising a central passage in which the adjustment mandrel is received, wherein relative rotation is restricted between the offset housing and the adjustment mandrel when the adjustment mandrel is in the first axial position and relative rotation is permitted between the offset housing and the adjustment mandrel when the adjustment mandrel is in the second axial position.

13. The downhole mud motor of claim 12, wherein the adjustment mandrel is configured to shift from the first axial position to the second axial position in response to supplying the downhole mud motor with drilling fluid at a threshold pressure or a threshold flowrate.

14. The downhole mud motor of claim 12, further comprising a locking piston configured to lock the bend adjustment assembly in the second position.

15. The downhole mud motor of claim 14, wherein the locking piston comprises a key displaceable directly and arcuately between a short slot and a long slot of the adjustment mandrel in response to actuation of the adjustment mandrel from the first axial position to the second axial position.

16. The downhole mud motor of claim 12, wherein the adjustment mandrel comprises an arcuate recess extending between a pair of shoulders;

the offset housing comprises an arcuate extension extending between a pair of shoulders; and one of the pair of shoulders of the offset housing engages one of the shoulders of the adjustment mandrel when the bend adjustment assembly is in the first position.

17. The downhole mud motor of claim 16, wherein the bend adjustment assembly is actuatable between the first position and the second position with the adjustment mandrel in the second axial position in response to a change in at least one of flowrate of the drilling fluid supplied to the downhole mud motor, pressure of the drilling fluid supplied to the downhole mud motor, and relative rotation between the driveshaft housing and the bearing mandrel.

18. The downhole mud motor of claim 12, further comprising a stepped flow restrictor positioned on an outer surface of the driveshaft, wherein the flow restrictor comprises a pair of axially spaced choke points configured to restrict a flow of the drilling fluid between the driveshaft and a locking piston disposed about the driveshaft and to provide a surface indication of the deflection angle of the bend adjustment assembly.

19. The downhole mud motor of claim 12, further comprising:

a shear pin configured to retain the adjustment mandrel in the first axial position, wherein the shear pin is configured to shear and release the adjustment mandrel from the first axial position in response to supplying the downhole mud motor with drilling fluid at a threshold pressure or a threshold flowrate; and a locking pin configured to retain the adjustment mandrel in the second axial position.

20. A method for forming a deviated borehole, comprising:

(a) providing a bend adjustment assembly of a downhole mud motor in a first position that provides a first deflection angle between a longitudinal axis of a driveshaft housing of the downhole mud motor and a longitudinal axis of a bearing mandrel of the downhole mud motor;

(b) actuating an adjustment mandrel of the bend adjustment assembly from a first axial position corresponding to the first position of the bend adjustment assembly to a second axial position axially spaced from the first position in response supplying the downhole mud motor with drilling fluid at a threshold pressure or a threshold flowrate; and (c) with the downhole mud motor positioned in the borehole, actuating the bend adjustment assembly from the first position to a second position that provides a second deflection angle between the longitudinal axis of the driveshaft housing and the longitudinal axis of the bearing mandrel, the second deflection angle being different from the first deflection angle;

wherein the bend adjustment assembly is prevented from actuating from the first position to the second position when the adjustment mandrel is in the first axial position, and wherein the bend adjustment assembly is permitted to actuate between the first position and the second position when the adjustment mandrel is in a second axial position that is axially spaced from the first axial position.

21. The method of claim 20, further comprising:

(d) ceasing the supply of drilling fluid to the bend adjustment assembly while retaining the bend adjustment assembly in the second position.

22. The method of claim 20, wherein (b) comprises shearing a shear pin coupled to the adjustment mandrel in response to supplying the downhole mud motor with the drilling fluid at the threshold pressure or the threshold flowrate.

23. The method of claim 20, further comprising:

(d) with the downhole mud motor positioned in the borehole and the adjustment mandrel disposed in the second axial position, actuating the bend adjustment assembly from the second position to a third position that provides a third deflection angle between the longitudinal axis of the driveshaft housing and the longitudinal axis of the bearing mandrel, the third deflection angle being different from the second deflection angle.

24. The method of claim 23, wherein the third deflection angle equals the first deflection angle.

25. The method of claim 23, wherein (d) comprises:

(d1) reducing a flowrate of the drilling fluid supplied to the downhole mud motor;

(d2) applying a weight on bit (WOB) to the downhole mud motor while rotating a drillstring coupled to the downhole mud motor from the surface; and (d3) increasing the flowrate of drilling fluid supplied to the downhole mud motor to lock the bend adjustment assembly in the third position.

26. The method of claim 23, wherein (d) comprises transferring torque between the bearing mandrel to an actuator housing by an actuator assembly of the bend adjustment assembly.

* * * * *